US006399292B2

(12) United States Patent
Fujiwara et al.

(10) Patent No.: US 6,399,292 B2
(45) Date of Patent: Jun. 4, 2002

(54) PHOTOTHERMOGRAPHIC PHOTOSENSITIVE MATERIAL AND PHOTOTHEMOGRAPHIC METHOD

(75) Inventors: Itsuo Fujiwara; Ichizo Toya, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/409,682

(22) Filed: Sep. 30, 1999

(30) Foreign Application Priority Data

Sep. 30, 1998 (JP) ..... 10-292853

(51) Int. Cl.[7] ..... G03C 1/498

(52) U.S. Cl. ..... 430/619; 430/523; 430/531; 430/950

(58) Field of Search ..... 430/619, 523, 430/531, 950

(56) References Cited

U.S. PATENT DOCUMENTS

| | | | | |
|---|---|---|---|---|
| 3,152,904 A | | 10/1964 | Sorensen et al. | |
| 3,457,075 A | | 7/1969 | Morgan et al. | |
| 5,750,328 A | * | 5/1998 | Melpolder et al. | 430/619 |
| 5,783,380 A | * | 7/1998 | Smith et al. | 430/619 |

OTHER PUBLICATIONS

Klosterboer, Thermally Processed Silver Systems, Chapter 9, pp. 279–280.

* cited by examiner

*Primary Examiner*—Thorl Chea
(74) *Attorney, Agent, or Firm*—Birch, Stewart, Kolasch & Birch, LLP

(57) ABSTRACT

A photothermographic material which contains on one side of a support (a) a catalytically active amount of a photocatalyst, (b) a reducing agent, (c) a reducible silver salt, and (d) a binder, wherein a matting agent having a softening temperature of from 100 to 500° C. is contained at least on one side of the support.

14 Claims, 1 Drawing Sheet

PHOTOTHERMOGRAPHIC PHOTOSENSITIVE MATERIAL AND PHOTOTHEMOGRAPHIC METHOD

FIELD OF THE INVENTION

The present invention relates to a photosensitive material for laser recording (hereinafter referred to as merely "a photosensitive material") which does not impair the durability of a heat developing part and is improved in traveling property (transportability) during heat development, and also relates to a photothermographic method. More particularly, the present invention relates to a photothermographic photosensitive material which is excellent in development processing stability, accordingly, having good photographic characteristics which can stably reproduce image information, and also relates to a photothermographic method.

BACKGROUND OF THE INVENTION

There are many photosensitive materials comprising a support having thereon a photosensitive layer, and image is formed by image exposure. Of these materials, techniques of forming images by heat development are widely known as systems capable of realizing environmental protection and simplifying image forming means.

Reduction of waste solutions has been strongly desired in recent years in the medical field from the viewpoint of environmental protection and space saving. Accordingly, photosensitive photothermographic materials for medical diagnosis and photography which can be exposed efficiently with a laser image setter or a laser imager and can form a clear black image exhibiting high resolving power and sharpness have been increasingly demanded. These photosensitive photothermographic materials can offer to customers a simpler and environmentally benign heat development processing system in which the use of solvent system processing chemicals can be done away with.

Method of forming images by heat development are described, for example, in U.S. Pat. Nos. 3,152,904 and 3,457,075, and D. Morgan and B. Shely, *Thermally Processed Silver Systems*, "Imaging Processes and Materials", Neblette Vol. 8, p.2, compiled by Sturge, V. Walworth, and A. Shepp (1969). These photosensitive materials contain a reducible photoinsensitive silver source (e.g., an organic silver salt), a catalytically active amount of a photocatalyst (e.g., a silver halide) and a reducing agent of silver generally having been dispersed in an organic binder matrix. Photosensitive materials are stable at ordinary temperature but when they are heated at a high temperature (e.g., 80° C. or more) after exposure, a silver is formed through an oxidation reduction reaction between a reducible silver source (which functions as an oxidizing agent) and a reducing agent. This oxidation reduction reaction is accelerated by the catalysis of a latent image which is generated by exposure. The silver which is formed by the reaction of a reducible silver salt in the exposure area provides a black image, which makes a contrast with a non-exposure area, thus an image is formed.

Heat development is advantageous environmentally in view of not producing waste solutions but has a drawback as to development processing stability (in particular, uneven density). This drawback can be improved by a method using a plate heater but the traveling property during heat development and the liability to damage of a plate heater come to problems in turn.

SUMMARY OF THE INVENTION

Accordingly, an object of the present invention is to provide a photothermographic photosensitive material which is excellent in traveling property during heat development and does not damage the surface of a heating means.

Another object of the present invention is to provide a photothermographic method which is superior in transporting property during heat development, does not damage the surface of a heating means and excellent in heat development processing stability.

The above objects of the present invention have been achieved by the following means.

(1) A photothermographic photosensitive material which contains on one side of a support (a) a catalytically active amount of photocatalyst, (b) a reducing agent, (c) a reducible silver salt, and (d) a binder, wherein a matting agent having a softening temperature of from 100 to 500° C. is contained at least on one side of the support.

(2) The photothermographic photosensitive material as described in the above item (1), wherein the photosensitive material has a layer containing a catalytically active amount of photocatalyst on one side of the support and contains the matting agent in the surface of the side of the support opposite to the side on which the layer containing a catalytically active amount of photocatalyst is provided.

(3) The photothermographic photosensitive material as described in the above item (1) or (2), wherein the number average particle diameter of the matting agent is from 0.2 to 30 $\mu$m.

(4) The photothermographic photosensitive material as described in the above item (1), (2) or (3), which is a photothermographic photosensitive material to be heat developed with a heat developing apparatus, wherein the photosensitive material contains the matting agent in the surface of the side of the support which is touched to the plate heater of the heat developing apparatus, and the dynamic friction coefficient between the plate heater and the surface containing the matting agent at 120° C. is 0.30 or less.

(5) The photothermographic photosensitive material as described in any of the above items (1) to (4), wherein the photosensitive material contains gelatin in the surface of the side of the support containing the matting agent.

(6) A photothermographic method which comprises heat developing by making the photothermographic photosensitive material as described in any of the above items (1) to (5) contact with the plate heater.

Key to the Symbols

Figure 1:
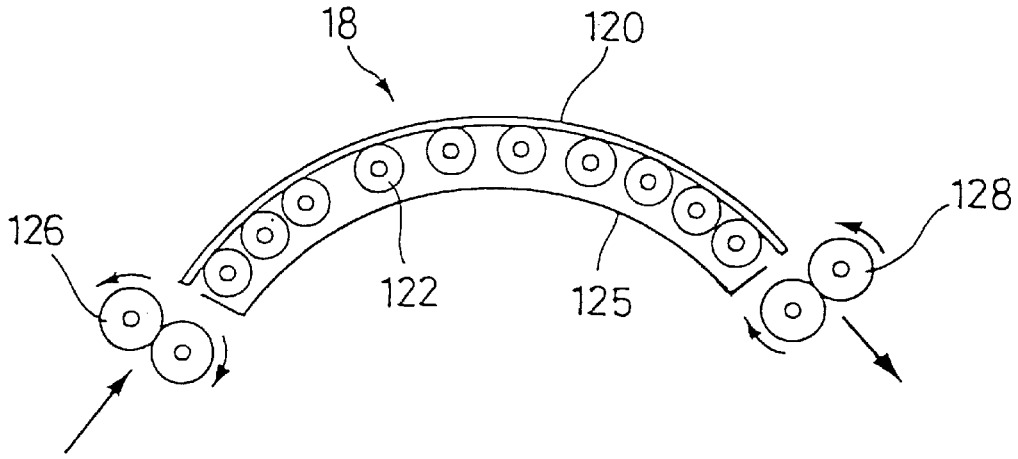
FIG. 1 is a schematic view showing one example of the heat developing part of the heat developing apparatus for use in the present invention.

| | |
|---|---|
| 18: | Heat developing part |
| 120: | Plate heater |
| 122: | Pressing roller |
| 130: | Driving roller |

DETAILED DESCRIPTION OF THE INVENTION

The present invention is described in detail below.

The photothermographic photosensitive material according to the present invention is a photosensitive material to be heat-developed, which contains a catalytically active amount of photocatalyst (specifically, a photosensitive silver halide), a reducing agent, a reducible silver salt (specifically, a photoinsensitive organic silver salt), and a binder, and has a layer containing a matting agent having a softening temperature (softening point) of from 100 to 500° C. at least on one side of the support. By the incorporation of such a matting agent, abrasion property can be improved, e.g., superior transporting property (traveling property) during heat development can be obtained and the damage of the surface of a heating means (e.g., a plate heater) can be done away with. On the other hand, when the softening temperature of the matting agent is less than 100° C., traveling property is deteriorated, while when it exceeds 500° C., the surface of a heating means becomes liable to be damaged. Further, a softening temperature can be measured by a differential scanning calorimeter (DSC), etc.

The image of the photothermographic photosensitive material according to the present invention is formed by heating after image exposure. A silver image of black color is formed by this heat development. Image exposure is preferably performed with laser beams. The heating temperature of the heat development is preferably from 80 to 250° C., more preferably from 100 to 200° C., and particularly preferably from 100 to 140° C. The heating time is generally from 1 second to 2 minutes, preferably from 10 to 90 seconds.

As a photothermographic method, a plate heater method in which heat development is performed by making a photosensitive material contact with a plate heater is preferred in view of transporting property. When a plate heater method is used, it is preferred that the layer of the photosensitive material of the side which is touched to the surface of the heater should in general contain a matting agent satisfying the condition of the present invention, and more preferably the back surface be photoinsensitive. Further, the dynamic friction coefficient between the plate heater and the surface of the layer side containing the matting agent (a matting agent-containing surface) at 120° C. is preferably 0.30 or less, more preferably from 0.1 to 0.25. The dynamic friction coefficient in this case can be calculated as follows. A plate heater of 120° C. and the photosensitive material are superposed so that the matting agent-containing surface of the photosensitive material is touched with the plate heater, a constant load is applied to the photosensitive material at a point of time when the temperature of the photosensitive material reached 120° C., and the dynamic friction coefficient can be calculated from the force necessary to move a photosensitive material at a constant rate. Such a friction coefficient can be obtained, besides the above matting agent, by controlling additives, such as surfactants and oils, and addition amounts.

A photothermographic method according to a plate heater method is specifically the method disclosed in Japanese Patent Application No. 9-229684 (JP-A-11-133572). This is a method using a heat developing apparatus to obtain a visible image by making a photothermographic photosensitive material, in which a latent image has been formed, contact with a heating means at a heat developing part. The foregoing heating means comprises a plate heater, and a plurality of pressing rollers are arranged along one surface of the plate heater vis-a-vis with the plate heater. Heat development is performed by passing the foregoing photothermographic photosensitive material between the above pressing rollers and the plate heater.

As a heat developing part of a heat developing apparatus applied to such a heating method, an embodiment shown in FIG. 1 can be exemplified.

As shown in FIG. 1, heat developing part 18 is a part to make a latent image a visible image by heat development by heating the photothermographic photosensitive material, which has been subjected to exposure, transported from the direction of the indicated arrow. The present invention is characterized in that heat developing part 18 comprises a plate heater 120 and a plurality of pressing rollers 122 arranged vis-a-vis with plate heater 120.

Plate heater 120 is a plate-like heating member encasing a heating unit such as nichrome wire laid down in a planar state, which is maintained at developing temperature of the photothermographic photosensitive material. The surface of plate heater 120 is preferably coated with fluororesins or stuck with a fluororesin sheet for the purpose of lessening a friction coefficient or giving abrasion resistance.

The volatile content of the photothermographic photosensitive material is evaporated by heating during heat development, as a result, the photothermographic photosensitive material rises from plate heater 120, and the contact of the photothermographic photosensitive material with plate heater 120 sometimes becomes uneven. Therefore, it is also preferred to form minute concavities and convexities on the surface of plate heater 120 to dissipate this vapor.

It is also preferred to provide temperature gradient so as to make the temperature of both ends of plate heater 120 higher than the temperature of other parts for compensating for the temperature reduction due to heat dissipation at both ends.

Pressing rollers 122 are arranged with a prescribed pitch being in contact with one surface of plate heater 120 or with a distance smaller than the thickness of the photothermographic photosensitive material along the entire length of the transporting direction of plate heater 120, and these pressing rollers 122 and plate heater 120 constitute the path of the photothermographic photosensitive material. Making the distance of the path of the photothermographic photosensitive material smaller than the thickness of the photothermographic photosensitive material can prevent the photothermographic photosensitive material from buckling. At both ends of the photothermographic photosensitive material path are arranged feeding rollers 126 for feeding the photothermographic photosensitive material to heat developing part 18 from the direction of the indicated arrow and discharging rollers 128 for discharging the photothermographic photosensitive material to the direction of the indicated arrow after heat development.

Further, it is preferred that heat insulating cover 125 for heat insulation is provided on the surface side of pressing rollers 122 opposite to plate heater 120 as shown in FIG. 1.

When the photothermographic photosensitive material is conveyed, if the tip of the photothermographic photosensitive material strikes against pressing roller 122, the photothermographic photosensitive material stops a moment. At that time, if pressing rollers 122 are arranged with the same pitch, the same part of the photothermographic photosensitive material stops at every pressing roller 122 and that part of the photothermographic photosensitive material is pressed against plate heater 120 for longer time, which sometimes results in generation of streaky uneven development stretching in the width direction. Therefore, it is preferred to make pitch of each pressing roller 122 uneven.

Figure 2:
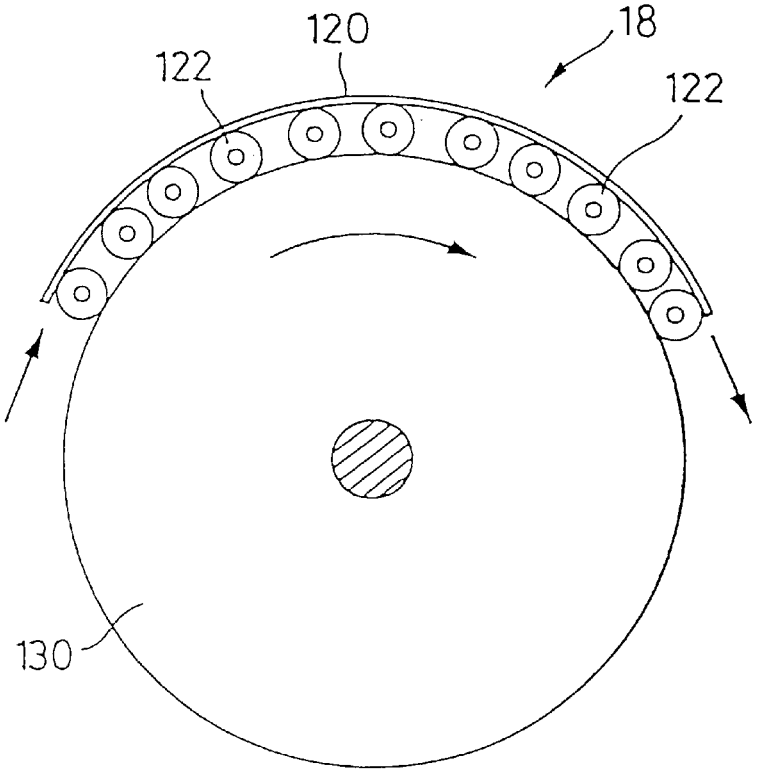
FIG. 2 is a schematic view showing other example of the heat developing part of the heat developing apparatus for use in the present invention.

As shown in FIG. 2, the constitution of heat developing part 18 may also be such that driving roller 130 is arranged in contact with each pressing roller 122 with making the enveloping surface of each pressing roller 122 the circumferential surface and each pressing roller 122 is rotated by the rotation of driving roller 130.

In the above explanation, plate heater 120 may also comprise a plate member comprising a heat conductor and a heat source arranged on the side of the plate member opposite to the heating side of the photothermographic photosensitive material.

The transporting property during heat development of the photothermographic photosensitive material of the present invention and the liability to damage of a plate heater can improved by using the matting agent according to the present invention. Among various well-known matting agents, those satisfying the softening point condition of the present invention can be arbitrarily selected, and those comprising fine particles of organic compounds are preferred above all. Specific examples of organic compounds which can be used as matting agents include, as water-dispersible vinyl polymers, polymethyl acrylate, high density polyethylene, polyacrylonitrile, polymethylpentene, acrylonitrile-α-methylstyrene copolymers, polystyrene, polyvinylidene chloride, styrene/divinylbenzene copolymers, polyvinyl acetate, polyethylene carbonate, thermosetting polybutadiene, polyallylate, and polytetrafluoroethylene, as cellulose derivatives, cellulose acetate and cellulose acetate propionate, as starch derivatives, carboxyl starch and carboxynitrophenyl starch, in addition, modified polyolefin, polyethylene terephthalate, phenolic resins, reinforced polyamide, polyamideimide, crosslinkable polymethyl methacrylate and TEFLON (polytetrafluoroethylene), but the present invention is not limited thereto.

As commercially available matting agents satisfying the condition of the present invention, e.g., SG-600 and SG-800 (manufactured by Soken Kagaku Co., Ltd.), Zonyl MP-1300 (manufactured by Mitsui Du Pont Fluoro Chemical Co., Ltd.) can be exemplified.

These matting agents can be mixed with different kinds of substances, if necessary. The number average particle diameter of the matting agent is preferably from 0.2 to 30 μm, more preferably from 1 to 15 μm. The shape of the matting agent is not particularly limited and arbitrary shapes such as a spherical, tabular, cubic, acicular, or amorphous shape can be used alone or in mixture.

The particle size distribution of the matting agent may be broad or narrow. As matting agents largely affect the haze of the photosensitive material and the surface gloss, it is desired to adjust particle size, particle shape and particle size distribution to a necessary condition when matting agents are prepared or by mixing a plurality of matting agents.

The addition amount of the matting agent according to the present invention is preferably from 10 to 400 mg, more preferably from 20 to 250 mg, in terms of a coating amount per $m^2$ of a photosensitive material (if the matting agent is contained in both sides of the support, in total amount). In addition to the matting agent according to the present invention, as described later, matting agents other than the matting agent of the present invention can further be used but the addition amount of such matting agents is preferably 80 wt % or less of the entire amount of the matting agents to be used.

The binders preferably used in the layer containing the matting agent in the present invention are transparent or translucent and generally colorless. A film is preferably formed out of synthetic resins of natural polymers, polymers and copolymers, in addition, media which can form a film, e.g., gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), poly(vinyl chloride), poly(methacrylate), copoly(styrene/maleic anhydride), copoly(styrene/acrylonitrile), copoly(styrene/butadiene), poly(vinyl acetals) (e.g., poly(vinyl formal), poly(vinyl butyral)), poly(esters), poly(urethanes), phenoxy resins, poly(vinylidene chloride), poly(epoxides), poly(carbonates), poly(vinyl acetates), cellulose esters, poly(amides), polyacrylamides, or dextrans. Gelatin is particularly preferably used. Binders may be formed from water, organic solvents or emulsions by covering.

The coating amount of the binder in the matting agent-containing layer is preferably from 0.1 to 5 g per $m^2$ of the photosensitive material.

As described above, gelatin is most preferably used as a binder in the matting agent-containing layer. It is preferred in the present invention that at least any layer of the matting agent-containing side is a gelatin binder layer.

In the present invention, it is a preferred embodiment for the backing layer to contain a matting agent. The matting degree of the backing layer according to the present invention is preferably Beck's smoothness of from 10 to 500 seconds, more preferably from 50 to 300 seconds.

In the present invention, matting agents are preferably added to the outermost surface layer, the layer which functions as the outermost surface layer, or the layer near the outer surface of the photosensitive material. They are also preferably added to the layer functioning as a protective layer. The matting degree of the emulsion surface-protective layer containing a photocatalyst is not particularly limited so long as star dust failure does not occur, but Beck's smoothness is preferably from 500 to 10,000 seconds, particularly preferably 2,000 seconds or less.

The photosensitive material according to the present invention is preferably a single side photosensitive material comprising a support having provided only on one side of the support a photosensitive layer (an emulsion layer) containing a silver halide emulsion, i.e., a photocatalyst. In such a material, it is more preferred to contain a matting agent, in particular, in the layer provided on the back side of the support, such as a backing layer.

The photothermographic photosensitive material according to the present invention preferably has, as the image-forming layer, a photosensitive layer comprising a photosensitive silver halide as a photocatalyst, a reducing agent, a reducible silver salt (e.g., an organic silver salt), and a toning agent for controlling tone of silver, if necessary, having been dispersed in a binder matrix. When such photothermographic photosensitive materials are heated at a high temperature (e.g., 80° C. or higher) after image exposure, a silver image of black color is formed through an oxidation reduction reaction between a silver halide or a reducible silver salt (which functions as an oxidizing agent) and a reducing agent. The oxidation reduction reaction is accelerated by the catalysis of a latent image of the silver halide which is generated by exposure. Accordingly, a black silver image is formed in an exposure area.

When the organic silver salt-containing layer (the image-forming layer) of the present invention is formed by coating and drying a coating solution in which 30 wt % or more of the solvent is occupied by water, it is preferred that a polymer latex, which is soluble or dispersible in a water system solvent (water solvent), in particular, an equilibrium moisture content at 25° C. 60% RH of which is 2 wt % or less, is further used as the binder of the organic silver salt-containing layer (hereinafter referred to as "the polymer according to the present invention") "A water system solvent" in which the polymer of the present invention is soluble or dispersible as used herein is water or water mixed with a water-miscible organic solvent in concentration of 70 wt % or less. As water-miscible organic solvents, alcohols such as methyl alcohol, ethyl alcohol, and propyl alcohol, cellosolves such as methyl cellosolve, ethyl cellosolve, and butyl cellosolve, ethyl acetate and dimethylformamide can be exemplified.

The system of a so-called dispersing state in which polymers are not dissolved thermodynamically is also called a water system solvent in the present invention. "An equilibrium moisture content at 25° C. 60% RH" used in the present invention can be represented as follows with the weight of the polymer in humidity conditioning equilibrium at 25° C. 60% RH being $W_1$ and the weight of the polymer at 25° C. dry state being $W_0$:

$$\text{An equilibrium moisture content at 25° C. 60\% RH} = [(W_1 - W_0)/W_0] \times 100 \text{ (wt \%)}$$

As for the definition and the measuring method of moisture content, e.g., *Polymer Engineering, Lecture* 14, "Test Methods of Polymeric Materials", compiled by Kobunshi-Gakkai, published by Chijin Shokan Co. Ltd. can be referred to.

The polymers according to the present invention are not particularly restricted so long as they are soluble or dispersible in the above-described water system solvent and have equilibrium moisture content at 25° C. 60% RH of 2 wt % or less. Of these polymers, polymers which are dispersible in a water system solvent are particularly preferred.

As examples of dispersion conditions, there are latexes in which fine particles of solid polymers are dispersed and dispersions in which polymer molecules are dispersed in a molecular state or with forming micells, and any of these can be preferably used.

The equilibrium moisture content at 25° C. 60% RH of the polymer according to the present invention is preferably 2 wt % or less, more preferably from 0.01 to 1.5 wt %, and still more preferably from 0.02 to 1 wt %.

Hydrophobic polymers such as an acrylic resin, a polyester resin, a rubber-based resin (e.g., an SBR resin), a polyurethane resin, a vinyl chloride resin, a vinyl acetate resin, a vinylidene chloride resin, and a polyolefin resin can be preferably used. Polymers may be straight chain, branched or crosslinked polymers. As polymers, any of homopolymers in which single monomers are polymerized and copolymers in which two or more monomers are copolymerized can be used. When copolymers are used, both of random copolymers and block copolymers can be used. The molecular weight of polymers is from 5,000 to 1,000,000, preferably from 10,000 to 200,000, in number average molecular weight. If the molecular weight is too small, the mechanical strength of the emulsion layer is insufficient, while when it is too large, the film-forming property is disadvantageously deteriorated.

The polymers according to the present invention comprise the foregoing polymers dispersed in a water system dispersion medium. "Water system dispersion medium" used herein means a dispersion system in which 30 wt % or more of the composition is occupied by water. As dispersion conditions, any of emulsified dispersion, micell dispersion, dispersion in which polymers having hydrophilic parts are dispersed in a molecular state can be used but latexes are particularly preferably used.

Specific examples of preferred polymers are shown below. In the following, polymers are indicated as raw material monomers, the numerical values in parentheses are wt % and the molecular weights are number average molecular weights.

| | |
|---|---|
| P-1: | Latex comprising MMA (70)-EA (27)-MAA (3) (molecular weight: 37,000) |
| P-2: | Latex comprising MMA (70)-2EHA (20)-St (5)-AA (5) (molecular weight: 40,000) |
| P-3: | Latex comprising St (70)-Eu (25)-AA (5) (molecular weight: 60,000) |
| P-4: | Latex comprising St (60)-Bu (35)-DVB (3)-MAA (2) (molecular weight: 150,000) |
| P-5: | Latex comprising VC (50)-MMA (20)-EA (20)-AN (5)-AA (5) (molecular weight: 80,000) |
| P-6: | Latex comprising VDC (85)-MMA (5)-EA (5)-MAA (5) (molecular weight: 67,000) |
| P-7: | Latex comprising Et (90)-MAA (10) (molecular weight: 12,000) |

Abbreviations in the above show the following monomers. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, and Et: ethylene.

The above-described polymers are commercially available and the following polymers can be used. As examples of acrylic resins, Sevian A-4635, 46583, and 4601 (manufactured by Daicel Chemical Industries Ltd.), Nipol Lx811, 814, 821, 820, and 857 (manufactured by Nippon Zeon Co., Ltd.), as examples of polyester resins, FINETEX ES650, 611, 675, and 850 (manufactured by Dainippon Chemicals and Ink Co., Ltd.), WD-size and WMS (manufactured by Eastman Chemical Co.), as examples of polyurethane resins, HYDRAN AP10, 20, 30, and 40 (manufactured by Dainippon Chemicals and Ink Co., Ltd.), as examples of rubber-based resins, LACSTAR 7310K, 3307B, 4700H, and 7132C (manufactured by Dainippon Chemicals and Ink Co., Ltd.), Nipol Lx416, 410, 438C, and 2507 (manufactured by Nippon Zeon Co., Ltd.), as examples of vinyl chloride resins, G351 and G576 (manufactured by Nippon Zeon Co., Ltd.), as examples of vinylidene chloride resins, L502 and L513 (manufactured by Asahi Chemical Industry Co., Ltd.), and as examples of olefin resins, Chemipearl S120 and SA100 (manufactured by Mitsui Petrochemical Industries, Ltd.) can be exemplified.

These polymers may be used alone as polymer latexes or two or more polymers may be blended, if necessary.

Styrene/butadiene copolymer latexes are particularly preferably used in the present invention. Styrene/butadiene copolymers may contain components other than styrene and butadiene, e.g., methyl methacrylate, ethyl acrylate, methacrylic acid, 2-ethylhexyl acrylate, acrylic acid, divinylbenzene, vinyl chloride, and acrylonitrile can be exemplified as other components. The weight ratio of the styrene monomer unit and the butadiene monomer unit in styrene/butadiene copolymers is preferably from 40/60 to 95/5. The ratio occupied by the styrene monomer unit and the butadiene monomer unit in the copolymer is preferably from 60 to 99 wt %. The preferred molecular weight is the same as above.

Styrene/butadiene copolymer latexes preferably used in the present invention are the foregoing P-3, P-4 and commercially available products LACSTAR-3307B, 7132C, and Nipol Lx416.

Hydrophilic polymers such as gelatin, polyvinyl alcohol, methyl cellulose, and hydroxypropyl cellulose may be added to the organic silver salt-containing layer of the photosensitive material of the present invention, according to necessity. The addition amount of these hydrophilic polymers is preferably 50 wt % or less, more preferably 30 wt % or less, and still more preferably 20 wt % or less, based on the total binder amount in the organic silver salt-containing layer.

The organic silver salt-containing layer according to the present invention is formed of polymer latexes. The weight ratio of the total binder/the organic silver salt in the organic silver salt-containing layer is preferably from 1/10 to 10/1, more preferably from 1/5 to 4/1.

Such an organic silver salt-containing layer is, in general, also a photosensitive layer (an emulsion layer) containing a photosensitive silver halide. In such a case, the weight ratio of the total binder/silver halide is preferably from 400 to 5, more preferably from 200 to 10.

The solvent for the coating solution of the organic silver salt-containing layer of the photosensitive material of the present invention (solvent and dispersion medium are briefly expressed solvent collectively) is a water system solvent containing 30wt % or more of water. As components other than water, water-miscible organic solvents such as methyl alcohol, ethyl alcohol, isopropyl alcohol, methyl cellosolve, ethyl cellosolve, dimethylformamide and ethyl acetate may be arbitrarily used in the coating solution. The water content in the solvent of the coating solution is preferably 50 wt % or more, more preferably 70 wt % or more. Preferred examples of compositions of the solvent include, in addition to water, water/methyl alcohol=90/10 (wt %), water/methyl alcohol=70/30, water/methyl alcohol/dimethylformamide=80/15/5, water/methyl alcohol/ethyl cellosolve=85/10/5, water/methyl alcohol/isopropyl alcohol=85/10/5, etc.

Organic silver salts which ca be used in the present invention are comparatively stable against light and capable of forming a silver image when heated at 80° C. or more in the presence of an exposed photocatalyst (a latent image of a photosensitive silver halide and the like) and a reducing agent. Organic silver salts may be arbitrary organic materials containing the source which can reduce silver ions. Silver salts of organic acids, in particular, silver salts of long chain aliphatic carboxylic acids having from 10 to 30, preferably from 15 to 28, carbon atoms are preferably used in the present invention. Complexes of organic or inorganic silver salts whose ligands have complex stability constant of from 4.0 to 10.0 are also preferred. Silver-supplying materials can account for preferably about 5 to 70 wt % of an image-forming layer. Preferred organic silver salts contain silver salts of organic compounds having a carboxyl group. These examples include silver salts of aliphatic carboxylic acids and silver salts of aromatic carboxylic acids but organic silver salts are not limited thereto. Preferred examples of silver salts of aliphatic carboxylic acids include silver behenate, silver stearate, silver oleate, silver laurate, silver caproate, silver myristate, silver palmitate, silver maleate, silver fumarate, silver tartrate, silver linoleate, silver butyrate, silver camphorate, and mixtures of these.

For coating organic silver salts, methods of treating organic silver salts as a fine dispersion are preferably used. As methods of finely dispersing organic silver salt crystallites, a method of mechanical dispersion in the presence of an auxiliary dispersant using well-known finely dispersing means (e.g., a high speed mixer, a homogenizer, a high speed impinging mill, a banbury mixer, a homomixer, a kneader, a ball mill, a vibrating ball mill, a planetary ball mill, an attritor, a sand mill, a beads mill, a colloid mill, a jet mill, a roller mill, a trommel and a high speed stone mill) is known. Finely dispersing apparatuses and techniques are described in detail, for example, in Toshio Kajiuchi, Hiroshi Usui, *Rheology of Dispersion System and Techniques of Dispersion*, pp. 357 to 403, Shinoyama Publishing Co., Ltd. (1991), *Advancement of Chemical Engineering, the* 24th *Series*, pp. 184 and 185, compiled by the Tokai Branch of the Chemical Engineering Society, published by Maki Shoten Publishing Co., Ltd. (1990), etc.

For treating organic silver salts in a water solvent, a method of treating organic silver salts as a dispersion finely dispersed in water is preferably used.

A high pressure homogenizer is preferably used for obtaining an organic silver salt water dispersion having a small particle size and with no agglomeration. As a dispersing apparatus of this type, Gaulin homogenizer has been known from old, but apparatuses which make it possible to realize dispersion at higher pressure have been developed in recent years. By way of representative examples, a microfluidizer (manufactured by Microfluidex International Corp.) and a nanomizer (manufactured by Tokushu Kika Kogyo Co., Ltd.) are exemplified. A dispersing method comprising steps of increasing the pressure and the flow rate of organic silver salts and then dropping the pressure is a preferred method for finely dispersing organic silver salts in water.

In addition to mechanical dispersion, organic silver salts may be coarsely dispersed in a solvent by pH controlling, and then atomized by changing the pH in the presence of an auxiliary dispersant. At this time, organic solvents may be used for the coarse dispersion and the organic solvents are in general removed after completion of the atomization.

It is preferred to perform preliminary dispersion of a starting solution prior to dispersing operation. As preliminary dispersing means, known dispersing means, e.g., a high speed mixer, a homogenizer, a high speed impinging mill, a banbury mixer, a homomixer, a kneader, a ball mill, a vibrating ball mill, a planetary ball mill, an attritor, a sand mill, a beads mill, a colloid mill, a jet mill, a roller mill, a trommel and a high speed stone mill, can be used. In addition to mechanical dispersion, a starting material may be coarsely dispersed in a solvent by pH controlling, and then atomized by changing the pH in the presence of an auxiliary dispersant. At this time, organic solvents may be used for coarse dispersion and the organic solvents are in general removed after completion of the atomization.

In the present invention, it is preferred to disperse organic silver salts in the presence of a dispersant soluble in an aqueous solvent (an auxiliary dispersant). Preferred examples of auxiliary dispersants include synthetic anion polymers such as polyacrylic acid, acrylic acid copolymers, maleic acid copolymers, maleic acid monoester copolymers, and acryloylmethylpropane sulfonic acid copolymers, semi-synthetic anion polymers such as carboxymethyl starch and carboxymethyl cellulose, anionic polymers such as alginic acid and pectic acid, anionic surfactants disclosed in JP-A-52-92716 (the term "JP-A" as used herein means an "unexamined published Japanese patent application") and WO 88/04794, compounds disclosed in Japanese Patent Application No. 7-350753, well-known anionic, nonionic and cationic surfactants, other well-known polymers such as polyvinyl alcohol, polyvinyl pyrrolidone, carboxymethyl cellulose, hydroxypropyl cellulose, and hydroxypropylmethyl cellulose, and natural high molecular compounds such as gelatin, and these compounds can be appropriately selected. Polyvinyl alcohols and water-soluble cellulose derivatives are particularly preferably used.

An auxiliary dispersant is in general mixed with the powder of an organic silver salt or an organic silver salt in a wet cake-like state before dispersion and fed to a dispersing apparatus as a slurry. Alternatively, an auxiliary dispersant may be previously mixed with an organic silver salt and subjected to heat treatment or treatment with a solvent and then made into the powder or wet cake of an organic silver salt. pH adjustment may be performed before, after or during dispersion with an appropriate pH adjustor.

The prepared dispersion can be preserved with stirring or in a highly viscous state with hydrophilic colloid (for example, in a jelly-like state using gelatin) for the purpose of preventing the precipitation of fine particles during preservation. Further, it is preferred to add preservatives for inhibiting the proliferation of various bacteria.

Organic silver salts which can be used in the present invention can be preferably desalted. Methods of desalting are not particularly limited and any known method can be used. For example, well-known methods such as centrifugal filtration, suction filtration, ultrafiltration, and washing of floc formed by agglomeration can be preferably used. Desalting is preferably performed after synthesis of organic silver salts until dispersion, but may be performed at any stage according to purposes.

The particle size of the organic silver salt solid fine particle dispersion (volume weighted average diameter) according to the present invention can be obtained from the particle size (volume weighted average diameter) obtained by irradiating the solid fine particle dispersion dispersed in a solution with laser beams, and finding the autocorrelation function to the time variation of fluctuation of light scattering. A solid fine particle dispersion preferably has the average particle size of from 0.05 to 10.0 $\mu$m, more preferably from 0.'to 5.0 $\mu$m, and still more preferably from 0.1 to 2.0 $\mu$m.

The particle size distribution of organic silver salts is preferably monodispersion. Specifically, the value obtained in terms of percentage by dividing the standard deviation of the volume weighted average diameter by the volume weighted average diameter (variation coefficient) is preferably 80% or less, more preferably 50% or less, and still more preferably 30% or less.

The shape of an organic silver salt can be obtained from the transmission electron microscopic image of an organic silver salt dispersion.

The organic silver salt solid fine particle dispersion for use in the present invention comprises at least an organic silver salt and water. The ratio of an organic silver salt to water is not particularly limited, but preferably an organic silver salt accounts for from 5 to 50 wt %, particularly preferably from 10 to 30 wt %, of the total composition. It is preferred to use the foregoing auxiliary dispersant but the use amount is preferably the possible minimum amount within the range capable of obtaining the smallest particle size. The amount of an auxiliary dispersant is preferably from 1 to 30 wt %, particularly preferably from 3 to 15 wt %, based on the organic silver salt.

A photosensitive material can be prepared by mixing a water dispersion solution of an organic silver salt and a water dispersion solution of a photosensitive silver salt according to the present invention. The mixing ratio of an organic silver salt and a photosensitive silver salt can be selected according to purposes. A photosensitive silver salt as a photocatalyst is used in a catalytically active amount but the ratio of a photosensitive silver salt to an organic silver salt is preferably from 1 to 30 mol %, more preferably from 3 to 20 mol %, and particularly preferably from 5 to 15 mol %. Mixture of two or more kinds of water dispersion solutions of organic silver salts and two or more kinds of water dispersion solutions of photosensitive silver salts is preferably used for adjusting photographic characteristics.

The organic silver salts according to the present invention can be used in a desired amount but is preferably from 0.1 to 5 g/m$^2$ , more preferably from 1 to 3 g/m$^2$, in terms of a coating amount per m$^2$ of a photosensitive material.

A photosensitive silver halide is preferably used as a photosensitive silver salt in the present invention.

Photosensitive silver halides for use in the present invention can be produced using well-known methods in this industry, e.g., the methods disclosed in Research Disclosure, No. 17029 (June, 1978) and U.S. Pat. No. 3,700,458 can be used. The grain size of photosensitive silver halides is preferably small for the purpose of suppressing the white turbidity after image formation to lower degree, specifically preferably 0.20 $\mu$m or less, more preferably from 0.01 to 0.15 $\mu$m, and still more preferably from 0.02 to 0.12 $\mu$m. The grain size in the present invention means the edge length when silver halide grains have a so-called regular crystal form such as a cubic or octahedral form, and when silver halide grains are tabular grains it means the diameter of a circle having the same area as the projected area of the main plane of the grain. When silver halide grains do not have regular crystal forms, e.g., in the case of a spherical or cylindrical form, the grain size means the diameter of the sphere having the same volume as the volume of the silver halide grains.

Silver halide grains may have a crystal form such as a cubic, octahedral, tabular, spherical, cylindrical, or pebble-like form. Cubic grains and tabular grains are particularly preferably used in the present invention. When tabular silver halide grains are used, they preferably have an average aspect ratio of from 100/1 to 2/1, more preferably from 50/1 to 3/1. Silver halide grains having rounded corners can also be preferably used in the present invention. Plane indices (Miller indices) of the outer surfaces of photosensitive silver halide grains are not particularly limited, but it is preferred that the proportion occupied by the planes having high ratio of spectral sensitizing efficiency when spectral sensitizing dyes to be used are adsorbed is high. The proportion occupied by such planes is preferably 50% or more, more preferably 65% or more, and still more preferably 80% or more. The ratio of Miller indices can be obtained by the method described in T. Tani, *J. Imaging Sci.,* 29, 165 (1985), which makes use of adsorption dependence of {111} plane and {100} plane in adsorption of sensitizing dyes. The halogen composition of the photosensitive silver halide for use in the present invention is not limited in particular. Any of silver chloride, silver chlorobromide, silver bromide, silver iodobromide, silver iodochlorobromide and silver iodide can be used, but silver bromide or silver iodobromide can be preferably used in the present invention. Particularly preferred is silver iodobromide. The silver iodide content is preferably from 0.1 to 40 mol %, more preferably from 0.1 to 20 mol %. The distribution of the halogen composition in the grain may be uniform, the halogen composition may be changed stepwise or may be changed continuously. As a preferred example, silver iodobromide grains having a high silver iodide content locally in the grain surface can be used. Silver halide grains having a core/shell structure can be preferably used. Grain structures are preferably from a double structure to a quintuple structure. Core/shell grains having a double structure to a quadruple structure can be more preferably used.

It is preferred for the photosensitive silver halide grains according to the present invention to contain at least one metal complex selected from rhodium, rhenium, ruthenium, osmium, iridium, cobalt, mercury and iron. These metal complexes may be used alone, or two or more complexes of the same or different metals can be used in combination. The content of these metal complexes is preferably from 1 nmol to 10 mmol, more preferably from 10 nmol to 100 $\mu$mol, per mol of the silver. Specific structures of the metal complexes which can be used in the present invention are disclosed in JP-A-7-225449. With respect to cobalt and iron compounds, hexacyano metal complexes can preferably be used. As specific examples, a ferricyanic acid ion, a ferrocyanic acid ion and a hexacyanocobaltic acid ion can be exemplified, but the present invention is not limited thereto. Metal complexes may be contained in silver halide uniformly, may be contained in high concentration in a core part, or may be contained in high concentration in a shell part without any limitation.

Photosensitive silver halide grains can be desalted by washing according to methods well-known in this industry, e.g., a noodle washing method or a flocculation method, but silver halide grains may be or may not be desalted in the present invention.

The photosensitive silver halide grains for use in the present invention are preferably chemically sensitized. Sulfur sensitization, selenium sensitization and tellurium sensitization can be used as preferred chemical sensitization as is well known in this industry. Noble metal sensitization using gold, platinum, palladium, iridium compounds, etc., and reduction sensitization can also be used. The compounds disclosed in JP-A-7-128768 can be preferably used in sulfur sensitization, selenium sensitization and tellurium sensitization as well as conventionally well-known compounds. The tellurium sensitizers which can be used in the present invention include, e.g., diacyltellurides, bis(oxycarbonyl) tellurides, bis(carbamoyl)tellurides, diacyltellurides, bis (oxycarbonyl)ditellurides, bis(carbamoyl)ditellurides, compounds having a P═Te bond, tellurocarboxylates, Te-organyltellurocarboxylates, di(poly)tellurides, tellurides, tellurols, telluroacetals, tellurosulfonates, compounds having a P—Te bond, Te-containing heterocyclic rings, tellurocarbonyl compounds, inorganic tellurium compounds, and colloidal tellurium. Chloroauric acid, potassium chloroaurate, potassium auric thiocyanate, gold sulfide, gold selenide, and compounds disclosed in U.S. Pat. No. 2,448,060 and British Patent 618,061 can preferably be used in noble metal sensitization. As specific compounds for use in reduction sensitization, for example, stannous chloride, aminoiminomethanesulfinic acid, hydrazine derivatives, borane compounds, silane compounds and polyamine compounds can be exemplified in addition to ascorbic acid and thiourea dioxide. Reduction sensitization can be performed by carrying out ripening with maintaining the pH and pAg of the emulsion at 7 or more and 8.3 or less, respectively. Moreover, reduction sensitization can be effected by introducing a single addition area of silver ions during grain formation.

The photosensitive silver halide according to the present invention is preferably used in an amount of from 0.01 to 0.5 mol, more preferably from 0.02 to 0.3 mol, and particularly preferably from 0.03 to 0.25 mol, per mol of the organic silver salt.

A reducing agent may be added to arbitrary layers in the photosensitive material of the present invention.

A reducing agent for organic silver salts may be an arbitrary substance for reducing silver ions to metal silver, preferably an organic substance. Conventional photographic developing agents such as phenidone, hydroquinone and catechol are useful, but a hindered phenol reducing agent is preferably used. A reducing agent should be contained in an amount of from 6 to 60 mol % of the organic silver salt. When a reducing agent is added to layers other than emulsion layers in a multilayer constitution, a somewhat higher amount, i.e., from 8 to 80 mol %, shows a desired tendency.

A variety of reducing agents for photothermographic photosensitive materials using organic silver salts are disclosed. For example, amidoxime (e.g., phenylamidoxime, 2-thienylamidoxime, and p-phenoxyphenylamidoxime); azine (e.g., 4-hydroxy-3,5-dimethoxybenzaldehydeazine); combinations of aliphatic carboxylic acid arylhydrazide and ascorbic acid (e.g., 2,2'-bis(hydroxymethyl)propionyl-β-phenylhydrazine and ascorbic acid); combinations of polyhydroxybenzene and hydroxylamine, reductone and/or hydrazine (e.g., combinations of hydroquinone and bis (ethoxyethyl)hydroxylamine, piperidino-hexose reductone or formyl-4-methylphenylhydrazine); hydroxamic acid (e.g., phenylhydroxamic acid, azine, p-hydroxyphenylhydroxamic acid, and β-anilinehydroxamic acid); combinations of azine and sulfonamidophenol (e.g., combinations of phenothiazine and 2,6-dichloro-4-benzenesulfonamidophenol); α-cyanophenylacetic acid derivatives (e.g., ethyl-α-cyano-2-methylphenylacetate, and ethyl-α-cyanophenylacetate); bis-β-naphthol (e.g., 2,2'-dihydroxy-1,1'-binaphthyl, 6,6'-bibromo-2,2'-dihydroxy-1,1'-binaphthyl, and bis(2-hydroxy-1-naphthyl)methane); combinations of bis-β-naphthol and 1,3-dihydroxybenzene derivatives (e.g., 2,4-dihydroxybenzophenone or 2',4'-dihydroxyacetophenone); 5-pyrazolone (e.g., 3-methyl-1-phenyl-5-pyrazolone); reductones (e.g., dimethylaminohexose reductone, anhydrodihydroaminohexose reductone, and anhydrodihydropiperidonehexose reductone); sulfonamidophenol reducing agents (e.g., 2,6-dichloro-4-benzenesulfonamidophenol and p-benzenesulfonamidophenol); 2-phenylindane-1,3-dione; chroman (e.g., 2,2-dimethyl-7-t-butyl-6-hydroxychroman); 1,4-dihydropyridine (e.g., 2,6-dimethoxy-3,5-dicarboethoxy-1,4-dihydropyridine); bisphenol (e.g., bis(2-hydroxy-3-t-butyl-5-methylphenyl)methane, 2,2-bis(4-hydroxy-3-methylphenyl)propane, 4,4-ethylidene-bis(2-t-butyl- 6-methylphenol), and 2,2-bis(3,5-dimethyl-4-hydroxyphenyl)propane); ascorbic acid derivatives (e.g., palmitic acid-1-ascorbil, stearic acid ascorbil); aldehyde and ketone of benzyl and acetyl; 3-pyrazolidone and a certain kind of indane-1,3-dione, etc., can be exemplified.

When "a toning agent", which is known as an additive for improving images, is used in addition to the above-described components, advantageous results can be obtained in some cases. For example, a toning agent may be added in an amount of from 0.1 to 10 wt % based on the entire silver retaining component. A toning agent is a well known material in photographic techniques as disclosed in U.S. Pat. Nos. 3,080,254, 3,847,612 and 4,123,282.

Examples of toning agents include phthalimide and N-hydroxyphthalimide; cyclic imide (e.g., succinimide, pyrazolin-5-one, quinazolinone, 3-phenyl-2-pyrazolin-5-one, 1-phenylurazol, quinazoline, and 2,4-thiazolidinedione); naphthalimide (e.g., N-hydroxy-1,8-naphthalimide); cobalt complexes (e.g., cobalt hexaminetrifluoroacetate); mercaptan (e.g., 3-mercapto-1,2,4-triazole, 2,4-dimercaptopyrimidine, 3-mercapto-4,5-diphenyl-1,2,4-triazole, and 2,5-dimercapto-1,3,4-thiadiazole); N-(aminomethyl)aryldicarboxyimide (e.g., (N,N-dimethylaminomethyl)phthalimide and N,N-(dimethylaminomethyl) naphthalene-2,3-dicarboxyimide); blocked pyrazole, isothiuronium derivatives, and a certain kind of photo-discoloring agent (e.g., N,N'- hexamethylenebis(1-carbamoyl- 3,5-dimethylpyrazole), 1,8-(3,6-diazaoctane)bis-(isothiuroniumtrifluoroacetate), and 2-tribromomethyl-sulfonyl)-(benzothiazole)); 3-ethyl-5-[(3-ethyl-2-benzo-thiazolinylidene)-1-methylethylidene]-2-thio-2,4-oxazolidinedione); phthalazinone, phthalazinone derivatives or metal salts thereof, or derivatives such as 4-(1-naphthyl)phthalazinone, 6-chlorophthalazinone, 5,7-dimethoxyphthalazinone, and 2,3-dihydro-1,4-phthalazinedione; combinations of phthalazinone and phthalic acid derivatives (e.g., phthalic acid, 4-methylphthalic acid, 4-nitrophthalic acid, and tetrachlorophthalic anhydride); phthalazine, phthalazine derivatives or metal salts thereof, or derivatives such as 4-(1-naphthyl) phthalazine, 6-chlorophthalazine, 5,7-dimethoxyphthalazine, and 2,3-dihydrophthalazine; combinations of phthalazine and phthalic acid derivatives (e.g., phthalic acid, 4-methylphthalic acid, 4-nitrophthalic acid, and tetrachlorophthalic anhydride); quinazolinedione, benzoxazine, naphthooxazine derivatives; rhodium complexes which function not only as toning agents but also as halide ion sources for forming silver halide on the site (e.g., ammoniumhexachlororhodate(III), rhodiumbromide, rhodium nitrate, and potassium hexachlororhodate(III); inorganic peroxides and persulfate (e.g. , ammonium peroxide disulfide, and hydrogen peroxide); benzoxazine-2,4-dione (e.g., 1,3-benzoxazine-2,4-dione, 8-methyl-1,3-benzoxazine-2,4-dione, and 6-nitro-1,3-benzoxazine-2,4-dione); pyrimidine and asymmetric triazine (e.g., 2,4-dihydroxypyrimidine and 2-hydroxy-4-aminopyrimidine); azauracil and tetraazapentalene derivatives (e.g., 3,6-dimercapto-1,4-diphenyl-1H,4H-2,3*a*,5,6*a-tetraazapentalene, and* 1,4-di(o-chlorophenyl)-3,6-dimercapto-1H,4H-2,3*a*,5,6*a-tetraazapentalene), etc., can be exemplified.*

The addition of antifoggants and stabilizer precursors to the silver halide emulsion or/and the organic silver salt according to the present invention prevents additional fog from occurring and the stability of sensitivity during storage from lowering. Appropriate antifoggants, stabilizers and stabilizer precursors, which can be used alone or in combination, are shown below: thiazonium salts disclosed in U.S. Pat. Nos. 2,131,038 and 2,694,716; azaindenes disclosed in U.S. Pat. Nos. 2,886,437 and 2,444,605; mercury salts disclosed in U.S. Pat. No. 2,728,663; urazols disclosed in U.S. Pat. No. 3,287,135; sulfocatechols disclosed in U.S. Pat. No. 3,235,652; oximes, nitrons and nitroindazoles disclosed in British Patent 623,448; polyvalent metal salts disclosed in U.S. Pat. No. 2,839,405; thiuronium salts disclosed in U.S. Pat. No. 3,220,839; palladium, platinum and gold salt disclosed in U.S. Pat. Nos. 2,566,263 and 2,597,915; halogen-substituted organic compounds disclosed in U.S. Pat. Nos. 4,108,665 and 4,442,202; triazines disclosed in U.S. Pat. Nos. 4,128,557, 4,137,079, 4,138,365 and 4,459,360; and phosphorus compounds disclosed in U.S. Pat. No. 4,411,985.

Antifoggants which are preferably used in the present invention are organic halides and those compounds disclosed in the following patents can be exemplified: JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737.

Although it is not necessary for the execution of the present invention, the addition of mercury(II) salts to the emulsion layer as an antifoggant sometimes brings about advantageous results. Preferred mercury(II) salts for this purpose are mercury acetate and mercury bromide.

The photothermographic photosensitive material according to the present invention may contain benzoic acids for the purpose of increasing sensitivity and preventing fog. Benzoic acids which can be used in the present invention may be any benzoic acid derivatives. The compounds disclosed in U.S. Pat. Nos. 4,784,939, 4,152,160, Japanese Patent Application Nos. 8-151242, 8-151241 and 8-98051 can be exemplified as examples having preferred structures. Benzoic acids of the present invention can be added anywhere of the photosensitive material, preferably added to the layers of the side on which a photosensitive layer, i.e., an image-forming layer, is provided, more preferably added to the organic silver salt-containing layer. The time of the addition of benzoic acids for use in the present invention may be at any stage of the preparation of the coating solution. When benzoic acids are added to the organic silver salt-containing layer, they may be added at any stage from the preparation stage of the organic silver salt to the preparation stage of the coating solution, but preferably they are added after preparation of the organic silver salt and immediately before coating of the coating solution. Benzoic acids for use in the present invention may be added in the form of, e.g., a powder, a solution, or a fine particle dispersion. They may be added as the mixed solution with other additives such as sensitizing dyes, reducing agents and toning agents. The addition amount of benzoic acids is not particularly limited, preferably from 1 $\mu$mol to 2 mol, more preferably from 1 mmol to 0.5 mol, per mol of the silver.

Any method can be used for the addition of a reducing agent, a toning agent and an antifoggant, which are necessary materials for the constitution of the photosensitive material according to the present invention. They are preferably added as a solid fine particle dispersion using a dispersant the same as the addition of an organic silver salt. The objective solid fine particle dispersion can be obtained by the same method which is used for obtaining the solid fine particle dispersion of organic silver salts. The average particle size of the solid fine particle dispersion is generally from 0.005 to 10 $\mu$m, preferably from 0.01 to 3 $\mu$m, and still more preferably from 0.05 to 0.5 $\mu$m.

Sensitizing dyes for use in the present invention are not restricted so long as they can spectrally sensitize silver halide grains in a desired wavelength region when they adsorbed onto silver halide grains. Sensitizing dyes such as a cyanine dye, a merocyanine dye, a complex cyanine dye, a complex merocyanine dye, a holopolar cyanine dye, a styryl dye, a hemicyanine dye, an oxonol dye and a hemioxonol dye can be used. Useful sensitizing dyes which can be used in the present invention are described, for example, in *Research Disclosure*, Vol. 17643, Item IV-A, p. 23 (December, 1978), *ibid.*, Vol. 1831, Item X, p. 437 (August, 1979) or the literature cited therein. In particular, sensitizing dyes having spectral sensitivity suitable for spectral characteristics of light sources of various laser imager, scanner, image setter, and process camera can be advantageously selected.

As examples of spectral sensitization to red light, as to a so-called red light source such as an He—Ne laser, a red light semiconductor laser and LED, Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818 (the term "JP-B" as used herein means an "examined Japanese patent publication "), Compounds I-1 to I-37 disclosed in JP-A-62-284343, and Compounds I-1 to I-34 disclosed in JP-A-7-287338 are advantageously selected.

As for semiconductor laser light sources having a wavelength region of from 750 to 1,400 nm, various known dyes, e.g., cyanine, merocyanine, styryl, hemicyanine, oxonol, hemioxonol and xanthene dyes, can advantageously exhibit spectral sensitization. Useful cyanine dyes are cyanine dyes having a basic nucleus such as a thiazoline nucleus, an oxazoline nucleus, a pyrroline nucleus, a pyridine nucleus, an oxazole nucleus, a thiazole nucleus, a selenazole nucleus, and an imidazole nucleus. Preferred useful cyanine dyes include an acidic nucleus such as a thiohydantoin nucleus, a rhodanine nucleus, an oxazolidinedione nucleus, a thiazolinedione nucleus, a barbituric acid nucleus, a thiazolinone nucleus, a malononitrile nucleus, and a pyrazolone nucleus in addition to the above basic nucleus. Of the above cyanine and merocyanine dyes, those having an imino group or a carboxyl group are particularly effective. Appropriate dyes can be optionally selected from known sensitizing dyes as disclosed, for example, in U.S. Pat. Nos. 3,761,279, 3,719,495, 3,877,943, British Patents 1,466,201, 1,469,117, 1,422,057, JP-B-3-10391, JP-B-6-52387, JP-A-5-341432, JP-A-6-194781, and JP-A-6-301141.

Particularly preferred structures of dyes for use in the present invention include cyanine dyes having a thioether bond-containing substituent (e.g., dyes disclosed in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, Published Japanese translation of PCT international publication for patent application (hereinafter referred to as JP-W) 7-500926, U.S. Pat. No. 5,541,054), dyes having a carboxylic acid group (e.g., dyes disclosed in JP-A-3-163440, JP-A-6-301141, U.S. Pat. No. 5,441,899), merocyanine dyes, polynuclear merocyanine dyes, polynuclear cyanine dyes (e.g., dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-W-55-50111, British Patent 1,467,638, U.S. Pat. No. 5,281,515).

Further, dyes forming J-band are disclosed in U.S. Pat. Nos. 5,510,236, 3,871,887 (dyes in Example 5), JP-A-2-96131 and JP-A-59-48753, which are preferably used in the present invention.

These sensitizing dyes may be used alone or in combination of two or more. A combination of sensitizing dyes is often used for the purpose of supersensitization. Further, dyes which themselves do not have a spectral sensitizing function or substances which substantially do not absorb visible light but show supersensitization can be incorporated into an emulsion with sensitizing dyes. Useful sensitizing dyes, combinations of dyes which show supersensitization, substances which show supersensitization are described in *Research Disclosure*, Vol. 176, No. 17643, Item IV-J, p. 23 (December, 1978), and JP-B-49-25500, JP-B-43-4933, JP-A-59-19032 and JP-A-59-192242.

Sensitizing dyes for use in the present invention may be used in combination of two or more. For the inclusion of sensitizing dyes in a silver halide emulsion, they maybe directly dispersed in an emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., and then added to an emulsion.

In addition, various methods can be used for the addition of sensitizing dyes to an emulsion, for example, a method in which sensitizing dyes are dissolved in a volatile organic solvent, the solution is dispersed in water or hydrophilic colloid and this dispersion is added to an emulsion as disclosed in U.S. Pat. No. 3,469,987, a method in which sensitizing dyes are dissolved in an acid and the solution is added to an emulsion, or sensitizing dyes are added to an emulsion as an aqueous solution coexisting with an acid or a base as disclosed in JP-B-44-23389, JP-B-44-27555 and JP-B-57-22091, a method in which dyes are added to an emulsion as an aqueous solution or a colloidal dispersion coexisting with a surfactant as disclosed in U.S. Pat. Nos. 3,822,135 and 4,006,025, a method in which dyes are directly dispersed in a hydrophilic colloid and the dispersion is added to an emulsion as disclosed in JP-A-53-102733 and JP-A-58-105141, or a method in which dyes are dissolved using a compound capable of red-shifting and the solution is added to an emulsion as disclosed in JP-A-51-74624 can be used. Further, ultrasonic waves can be used for dissolution.

The time of the addition of the sensitizing dyes for use in the present invention to the silver halide emulsion of the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical sensitization, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during ripening stage and the remaining after completion of chemical sensitization. The kinds of compounds added separately and combinations of compounds may be varied.

The use amount of the sensitizing dyes according to the present invention may be selected according to properties such as sensitivity and fog, but is preferably from $10^{-6}$ to 1 mol, more preferably from $10^{-4}$ to $10^{-1}$ mol, per mol of the silver halide in the photosensitive layer.

The photosensitive material of the present invention can contain a mercapto compound, a disulfide compound and a thione compound with a view to controlling development by the inhibition and acceleration of development, improving spectral sensitization efficiency and improving storage stability before and after development.

When a mercapto compound is used in the present invention, a mercapto compound having any structure can be used but a mercapto compound represented by formula Ar—SM° or Ar—S—S—Ar is preferred. In the formulae, M° represents a hydrogen atom or an alkali metal atom, and Ar represents an aromatic ring group or a condensed aromatic ring group having one or more nitrogen, sulfur, oxygen, selenium or tellurium atoms. The heterocyclic aromatic ring in these groups is preferably benzimidazole, naphthimizole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. This heterocyclic aromatic ring may have a substituent selected from the group consisting of a halogen atom (e g., Br, Cl), a hydroxyl group, an amino group, a carboxyl group, an alkyl group (having 1 or more, preferably from 1 to 4, carbon atoms), and an alkoxyl group (having 1 or more, preferably from 1 to 4, carbon atoms). Examples of mercapto-substituted heterocyclic aromatic compounds include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4,5-diphenyl-2-imidazole thiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinoline thiol, 2,3,5,6-tetrachloro-4-pyridine thiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole, but the present invention is not limited thereto.

Mercapto compounds are added in the emulsion layer preferably in an amount of from 0.001 to 1.0 mol, more preferably from 0.01 to 0.3 mol, per mol of the silver.

The photosensitive layer of the present invention can contain, as a plasticizer and a lubricant, polyhydric alcohols (e.g., glycerins and diols disclosed in U.S. Pat. No. 2,960,404), fatty acids or fatty acid esters disclosed in U.S. Pat. Nos. 2,588,765 and 3,121,060, and silicone resins disclosed in British Patent 955,061.

A superhigh contrast agent can be used in the present invention for forming a superhigh contrast image. For example, hydrazine derivatives disclosed in U.S. Pat. Nos. 5,464,738, 5,496,695, 6,512,411, 5,536,622, Japanese Patent Application Nos. 7-228627, 8-215822, 8-130842, 8-148113, 8-156378, 8-148111, and 8-148116, compounds having a quaternary nitrogen atom disclosed in Japanese Patent Application No. 8-83566, and acrylonitrile compounds disclosed in U.S. Pat. No. 5,545,515 can be used. Specific examples of the compounds include Compounds 1 to 10 disclosed in U.S. Pat. No. 5,464,738, H-1 to H-28 in U.S. Pat. No. 5,496,695, I-1 to I-86 in Japanese Patent Application No. 8-215822, H-1 to H-62 in Japanese Patent Application No. 8-130842, 1-1 to 1-21 in Japanese Patent Application No. 8-148113, 1 to 50 in Japanese Patent Application No. 8-148111, 1 to 40 in Japanese Patent Application No. 8-148116, P-1 to P-26 and T-1 to T-18 in Japanese Patent Application No. 8-83566, and CN-1 to CN-13 in U.S. Pat. No. 5,545,515.

For forming a superhigh contrast image, a superhigh contrast accelerator can be used in the present invention in combination with the above-described superhigh contrast agents. For example, amine compounds disclosed in U.S. Pat. No. 5,545,505, specifically Compounds AM-1 to AM-5; hydroxamic acids disclosed in U.S. Pat. No. 5,545,507, specifically HA-1 to HA-11; acrylonitriles disclosed in U.S. Pat. No. 5,545,507, specifically CN-1 to CN-13; hydrazine compounds disclosed in U.S. Pat. No. 5,558,983, specifically CA-1 to CA-6; and onium salts disclosed in Japanese Patent Application No. 8-132836, specifically A-1 to A-42, B-1 to B-27, and C-1 to C-14 can be used.

Synthesizing methods, addition methods, and addition amounts of each of the foregoing superhigh contrast agents and superhigh contrast accelerators described in the above-cited respective patents can be used.

The photosensitive material according to the present invention can be provided with a surface protective layer for the purpose of preventing adhesion of the photosensitive layer (image-forming layer). The binder of the surface protective layer of the present invention is not particularly limited and natural and synthetic resins and synthetic polymers which can be used in the image-forming layer can preferably used. It is preferred to use an adhesion preventing agent in the surface protective layer according to the present invention. Examples of adhesion preventing agents include waxes, silica particles, styrene-containing elastomeric block copolymers (e.g., styrene/butadiene/styrene, styrene/isoprene/styrene), cellulose acetate, cellulose acetate butyrate, cellulose propionate, and mixtures of these.

The emulsion layer, i.e., image-forming layer, or the protective layer of the emulsion layer according to the present invention can contain light absorbing substances and filter dyes disclosed in U.S. Pat. Nos. 3,253,921, 2,274,782, 2,527,583 and 2,956,879. Further, dyes can be mordanted as disclosed in U.S. Pat. No. 3,282,699. With respect to the use amount of filter dyes, the absorbance at exposure wavelength is preferably from 0.1 to 3.0, particularly preferably from 0.2 to 1.5.

Various kinds of dyes and pigments can be used in the photosensitive layer of the photothermographic photosensitive material of the present invention with a view to improving tone and preventing irradiation. Any dye and pigment can be used in the photosensitive layer of the present invention, e.g., pigments and dyes described in Color Index may be used. Specifically, pyrazoloazole dyes, anthraquinone dyes, azo dyes, azomethine dyes, oxonol dyes, carbocyanine dyes, styryl dyes, triphenylmethane dyes, indoaniline dyes, and indophenol dyes, and organic and inorganic pigments including phthalocyanine. Examples of preferred dyes for use in the present invention include anthraquinone dyes (e.g., Compounds 1 to 9 disclosed in JP-A-5-341441, Compounds 3–6 to 3–18 and 3–23 to 3–38 disclosed in JP-A-5-165147), azomethine dyes (e.g., Compounds 17 to 47 disclosed in JP-A-5-341441), indoaniline dyes (e.g., Compounds 11 to 19 disclosed in JP-A-5-289227, Compound 47 disclosed in JP-A-5-341441, Compounds 2–10 and 2–11 disclosed in JP-A-5-165147), and azo dyes (e.g., Compounds 10 to 16 disclosed in JP-A-5-341441). These dyes may be added in the form of, e.g., a solution, an emulsion, a solid fine particle dispersion, or in the state mordanted by a high molecular mordant. The amount of these compounds is determined by the desired absorbing amount but, in general, from 1 $\mu$g to 1 g per $m^2$ of the photosensitive material is preferred.

The photothermographic photosensitive material according to the present invention is preferably a so-called single side photosensitive material comprising a support having provided on one side of the support at least one photosensitive layer containing a silver halide emulsion, and a backing layer on the other side of the support.

It is preferred in the present invention that the backing layer has the maximum absorption of about from 0.1 to 2.0 in a desired wavelength region. When a desired wavelength region is from 750 to 1,400 nm, the absorption in the visible region is preferably 0.005 or more and less than 0.5, more preferably the backing layer is an antihalation layer having the optical density of 0.001 or more and less than 0.3. When a desired wavelength region is 750 nm or less, the maximum absorption in a desired wavelength region before image formation is preferably from 0.1 to 2.0 and the antihalation layer has the optical density after image formation of from 0.005 or more and less than 0.3. Methods of reducing the optical density after image formation to the above range are not particularly restricted and, e.g., a method to reduce the density due to a dye by achromatization by means of heating as disclosed in Belgian Patent 733,706, and a method to reduce the density by achromatization by irradiation with light as disclosed in JP-A-54-17833 can be exemplified.

Above all, the achromatization technique disclosed in Japanese Patent Application No. 9-306403 is preferred.

As antihalation dyes, any compound can be used so long as it shows objective absorption at a desired wavelength and capable of achromatization after image formation. The cyanine dye or the salt thereof represented by the following formula (I) is preferably used in the present invention:

(I)

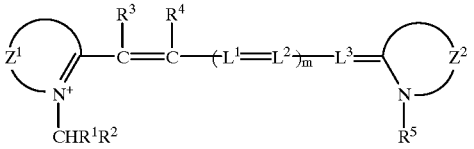

wherein $R^1$ represents an electron attractive group; $R^2$ represents a hydrogen atom, an aliphatic group or an aromatic group; $R^3$ and $R^4$ each represents a hydrogen atom, a halogen atom, an aliphatic group, an aromatic group, $—NR^6R^7$, $—OR^6$ or $—SR^7$; $R^6$ and $R^7$ each represents a hydrogen atom, an aliphatic group, or an aromatic group; $R^5$ represents an aliphatic group; $L^1$, $L^2$ and $L^3$ each represents a methine group which may be substituted, and the substituents of the methine groups may be bonded to form an unsaturated aliphatic ring or an unsaturated heterocyclic ring; $Z^1$ and $Z^2$ each represents an atomic group for forming a 5- or 6-membered nitrogen-containing heterocyclic ring, the nitrogen-containing heterocyclic ring may be condensed with an aromatic ring, and the nitrogen-containing heterocyclic ring and the condensed ring thereof may have a substituent; and m represents 0, 1, 2 or 3.

Formula (I) will be described in detail below.

In formula (I) $R^1$ represents an electron attractive group, and an electron attractive group having a Hammett's substituent constant σm value (described, e.g., in *Chem. Rev.,* 91, 165 (1991)) of from 0.3 to 1.5 is preferred, and a substituent represented by $—C(=O)R^{11}$ or $—SO_pR^{12}$, or a cyano group is more preferred; $R^{11}$ represents a hydrogen atom, an aliphatic group, an aromatic group, $—OR^{13}$, $—SR^{13}$, or $—NR^{13}R^{14}$; $R^{12}$ represents an aliphatic group, an aromatic group, $—OR^{13}$, or $—NR^{13}R^{14}$; p represents 1 or 2; $R^{13}$ and $R^{14}$ each represents a hydrogen atom, an aliphatic group, or an aromatic group, or $R^{13}$ and $R^{14}$ are bonded to each other to form a nitrogen-containing heterocyclic ring. $R^1$ still more preferably represents $—C(=O)R^{11}$, and most preferably $—C(=O)R^{11}$ wherein $R^{11}$ represents $—OR^{13}$ or $—NR^{13}R^{14}$.

"An aliphatic group" means an alkyl group, a substituted alkyl group, an alkenyl group, a substituted alkenyl group, an alkynyl group, a substituted alkynyl group, an aralkyl group, or a substituted aralkyl group. In the present invention, an alkyl group, a substituted alkyl group, an alkenyl group, a substituted alkenyl group, an aralkyl group, or a substituted aralkyl group is preferred, and an alkyl group, a substituted alkyl group, an aralkyl group, or a substituted aralkyl group is still more preferred. A chain aliphatic group is preferable to a cyclic aliphatic group. A chain aliphatic group may be branched.

The alkyl group preferably has from 1 to 30, more preferably from 1 to 20, and still more preferably from 1 to 15, carbon atoms. The alkyl moiety of the substituted alkyl group is the same as the alkyl group.

The alkenyl group and the alkynyl group each has from 2 to 30, more preferably from 2 to 20, and still more preferably from 2 to 15, carbon atoms. The alkenyl moiety of the substituted alkenyl group and the alkynyl moiety of the substituted alkynyl group are respectively the same as the alkenyl group and the alkynyl group.

"An aromatic group" means an aryl group or a substituted aryl group.

The aryl group preferably has from 6 to 30, more preferably from 6 to 20, and still more preferably from 6 to 15, carbon atoms. The aryl moiety of the substituted aryl group is the same as the aryl group.

The substituents each of the above groups may have are not particularly limited, and examples of substituents include a carboxyl group (which may be in the form of a salt), a sulfo group (which may be in the form of a salt), a sulfonamido group having from 1 to 20 carbon atoms (e.g., methanesulfonamido, benzenesulfonamido, butanesulfonamido, n-octanesulfonamido), a sulfamoyl group having from 0 to 20 carbon atoms (e.g., unsubstituted sulfamoyl, methylsulfamoyl, phenylsulfamoyl, butylsulfamoyl), a sulfonylcarbamoyl group having from 2 to 20 carbon atoms (e.g., methanesulfonylcarbamoyl, propanesulfonylcarbamoyl, benzenesulfonylcarbamoyl), an acylsulfamoyl group having from 1 to 20 carbon atoms (e.g., acetylsulfamoyl, propionylsulfamoyl, benzoylsulfamoyl), a chain or cyclic alkyl group having from 1 to 20 carbon atoms (e.g., methyl, ethyl, cyclohexyl, 2-hydroxyethyl, 4-carboxybutyl, 2-methoxyethyl, benzyl, 4-carboxybenzyl, 2-diethylaminoethyl), an alkenyl group having from 2 to 20 carbon atoms (e.g., vinyl, allyl), an alkoxyl group having from 1 to 20 carbon atoms (e.g., methoxy, ethoxy, butoxy), a halogen atom (e.g., F, Cl, Br), an amino group having from 0 to 20 carbon atoms (e.g., unsubstituted amino, dimethylamino, diethylamino, carboxyethylamino), an alkoxycarbonyl group having from 2 to 20 carbon atoms (e.g., methoxycarbonyl), an amido group having from 1 to 20 carbon atoms (e.g., acetamido, benzamido), a carbamoyl group having from 1 to 20 carbon atoms (e.g., unsubstituted carbamoyl, methylcarbamoyl, phenylcarbamoyl), an aryl group having from 6 to 20 carbon atoms (e.g., phenyl, naphthyl, 4-carboxyphenyl, 4-methanesulfonamidophenyl, 3-benzoylaminophenyl), an aryloxy group having from 6 to 20 carbon atoms (e.g., phenoxy, 3-methylphenoxy, naphthoxy), an alkylthio group having from 1 to 20 carbon atoms (e.g., methylthio, octylthio), an arylthio group having from 6 to 20 carbon atoms (e.g., phenylthio, naphthylthio), an acyl group having from 1 to 20 carbon atoms (e.g., acetyl, benzoyl, 4-chlorobenzoyl), a sulfonyl group having from 1 to 20 carbon atoms (e.g., methanesulfonyl, benzenesulfonyl), a ureido group having from 1 to 20 carbon atoms (e.g., methylureido, phenylureido), an alkoxycarbonylamino group having from 2 to 20 carbon atoms (e.g., methoxycarbonylamino, hexyloxycarbonylamino), a cyano group, a hydroxyl group, a nitro group, and a heterocyclic group (e.g., a 5-ethoxycarbonylbenzoxazole ring, a pyridine ring, a sulforan ring, a furan ring, a pyrrole ring, a pyrrolidine ring, a morpholine ring, a piperazine ring, a pyrimidine ring as a heterocyclic ring).

In formula (I), $R^2$ represents a hydrogen atom, an aliphatic group or an aromatic group. The definitions of the aliphatic group and the aromatic group are as described above. $R^2$ preferably represents a hydrogen atom or an aliphatic group, more preferably a hydrogen atom or an alkyl group, and still more preferably a hydrogen atom or an alkyl group having from 1 to 15 carbon atoms, and most preferably a hydrogen atom.

In formula (I), $R^3$ and $R^4$ each represents a hydrogen atom, a halogen atom, an aliphatic group, an aromatic group, —$NR^6R^7$, —$OR^6$ or —$SR^7$, $R^6$ and $R^7$ each represents a hydrogen atom, an aliphatic group, or an aromatic group. The definitions of the aliphatic group and the aromatic group are as described above. $R^3$ and $R^4$ each preferably represents a hydrogen atom or an aliphatic group, more preferably a hydrogen atom, an alkyl group, a substituted alkyl group, an aralkyl group, or a substituted aralkyl group, still more preferably a hydrogen atom, an alkyl group, or an aralkyl group, and most preferably a hydrogen atom.

In formula (I), $R^5$ represents an aliphatic group. The definition of the aliphatic group is as described above. $R^5$ preferably represents a substituted alkyl group. For the easiness of synthesis, $R^5$ particularly preferably represents a substituted alkyl group having the same definition as —$CHR^1R^2$.

In formula (I), $L^1$, $L^2$ and $L^3$ each represents methine which may be substituted. Substituents of the methine include a halogen atom, an aliphatic group, and an aromatic group. The definitions of the aliphatic group and the aromatic group are as described above. The substituents of the methine may be bonded to form an unsaturated aliphatic ring or an unsaturated heterocyclic ring. An unsaturated aliphatic ring is preferable to an unsaturated heterocyclic ring. The ring to be formed is preferably a 6- or 7-membered ring, more preferably a cycloheptene ring or a cyclohexene ring. Most preferably the methine is unsubstituted methine or to form a cycloheptene ring or a cyclohexene ring.

In formula (I), $Z^1$ and $Z^2$ each represents an atomic group for forming a 5- or 6-membered nitrogen-containing heterocyclic ring. Examples of the nitrogen-containing heterocyclic rings include an oxazole ring, a thiazole ring, a selenazole ring, a pyrroline ring, an imidazole ring and a pyridine ring. A 5-membered ring is preferable to a 6-membered ring. The nitrogen-containing heterocyclic ring may be condensed with an aromatic ring (e.g., a benzene ring, a naphthalene ring). The nitrogen-containing heterocyclic ring and a condensed ring thereof may have a substituent. The substituents are as described above.

In formula (I), m represents 0, 1, 2 or 3.

It is preferred that the cyanine dye represented by formula (I) forms a salt with the anion when used. When the cyanine dye represented by formula (I) has an anionic group such as carboxyl or sulfo as a substituent, the dye can form an intramolecular salt. In other cases, it is preferred for the cyanine dye to form a salt with the anion out of the molecule. The anion is preferably monovalent or divalent, more preferably monovalent. Examples of anions in this case include a halogen ion (e.g., $Cl^-$, $Br^-$, $I^-$), a p-toluenesulfonate ion, an ethyl sulfate ion, a 1,5-disulfonaphthalene dianion, $PF_6^-$, $BF_4^-$, and $ClO_4^-$.

A preferred cyanine dye is represented by the following formula (Ia):

(Ia)

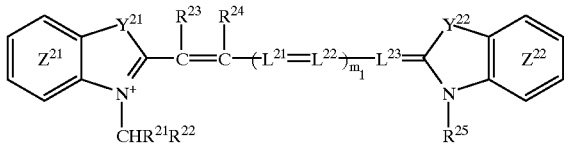

wherein $R^{21}$, $R^{22}$, $R^{23}$, $R^{24}$, $R^{25}$, $L^{21}$, $L^{22}$, $L^{23}$, and $m_1$ have the same meaning respectively as $R^1$, $R^2$, $R^3$, $R^4$, $R^5$, $L^1$, $L^2$, $L^3$, and m in formula (I).

In formula (Ia), $Y^{21}$ and $Y^{22}$ each represents —$CR^{26}R^{27}$, —$NR^{26}$—, —O—, —S— or —Se—; $R^{26}$ and $R^{27}$ each represents a hydrogen atom or an aliphatic group, and $R^{26}$ and $R^{27}$ may be bonded to each other to form a ring. The aliphatic group is particularly preferably an alkyl group or a substituted alkyl group.

In formula (Ia), benzene rings $Z^{21}$ and $Z^{22}$ may be condensed with other benzene ring. Benzene rings $Z^{21}$, $Z^{22}$ and condensed rings thereof may have a substituent. The substituents are as described above.

In formula (Ia), $m_1$ is 0, 1, 2 or 3.

It is preferred that the cyanine dye represented by formula (Ia) forms a salt with the anion when used. The formation of the salt is as described in formula (I) above.

Specific examples of the dyes are shown below but the present invention is not limited thereto.

(1)

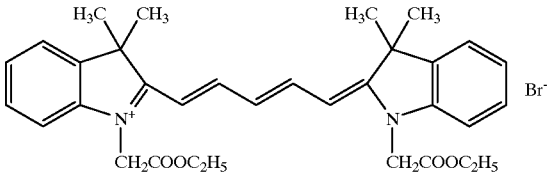

(2)

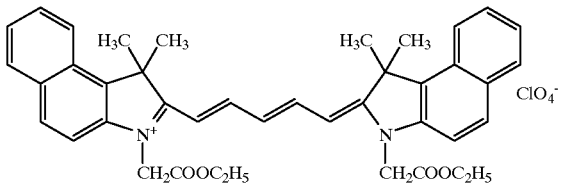

(3)

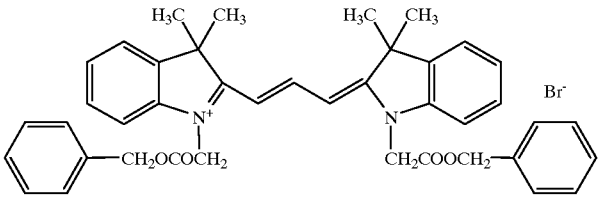

(4)

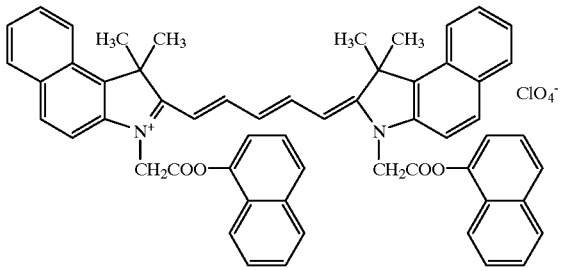

-continued
(5)
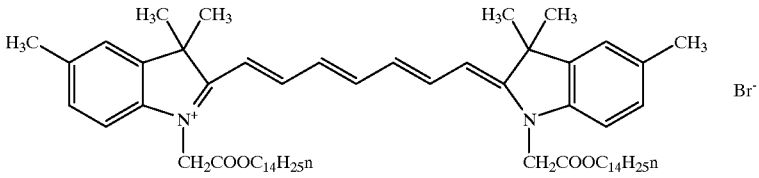
(6)
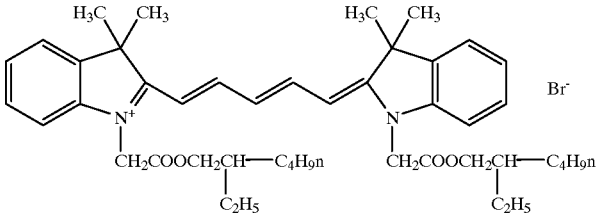
(7)
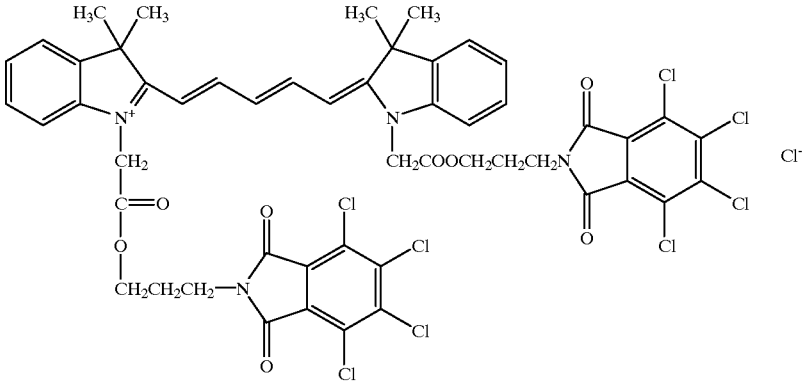
(8)
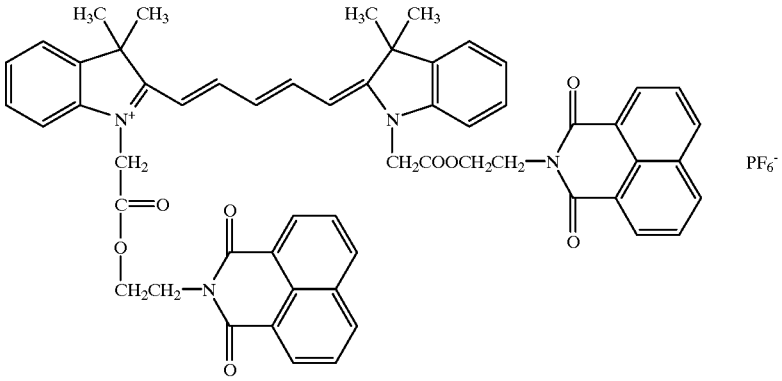
(9)
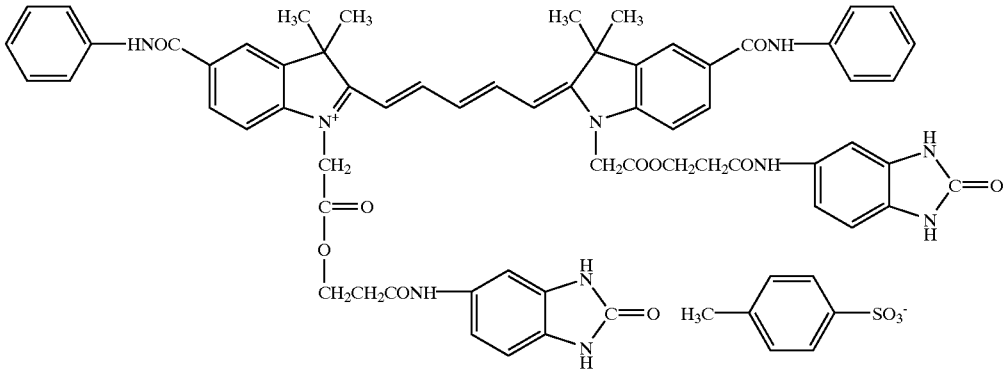

-continued
(10)
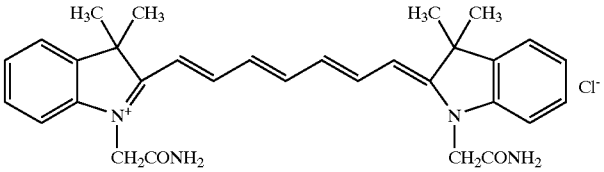
(11)
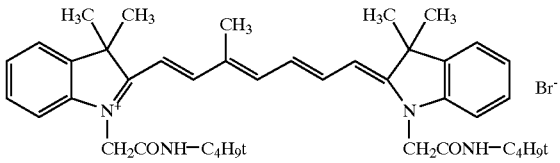
(12)
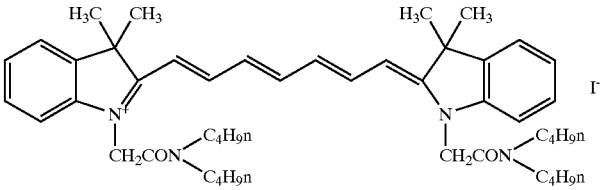
(13)
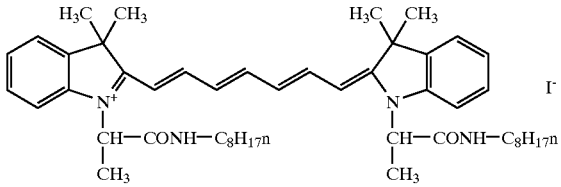
(14)
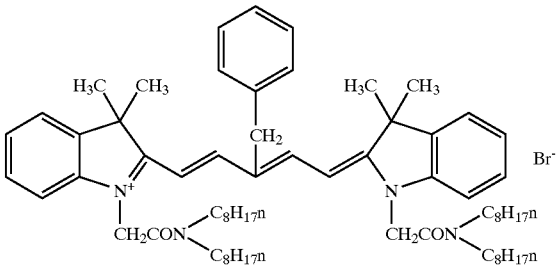
(15)
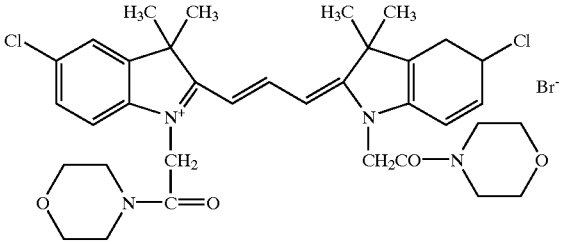
(16)
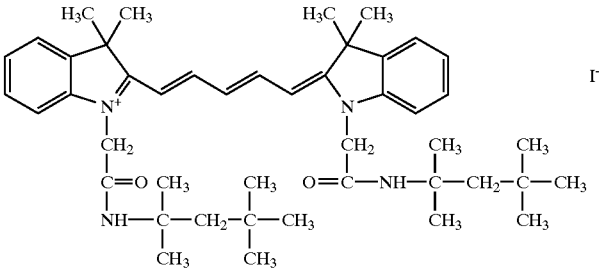
(17)
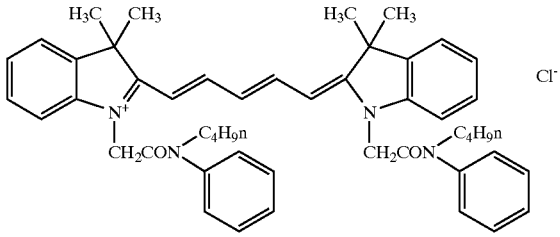
(18)
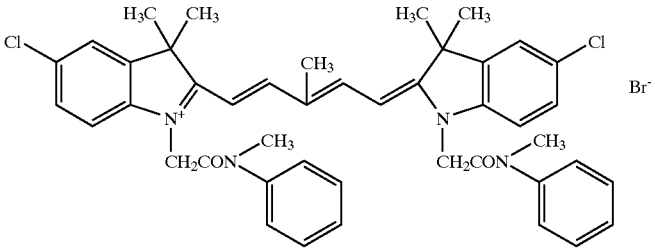
(19)
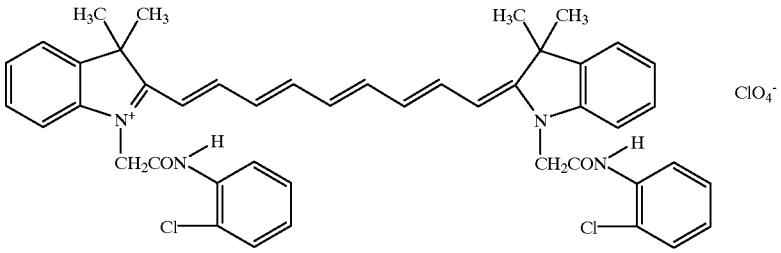

-continued
(20)
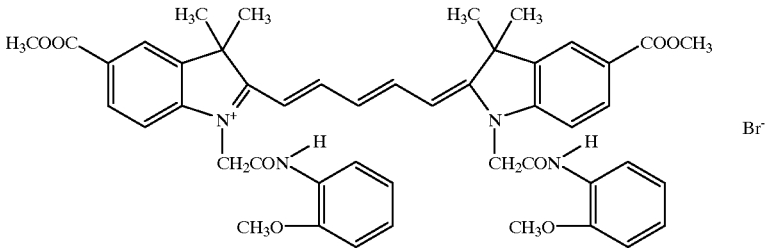
(21)
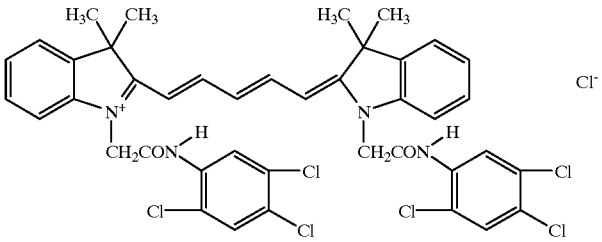
(22)
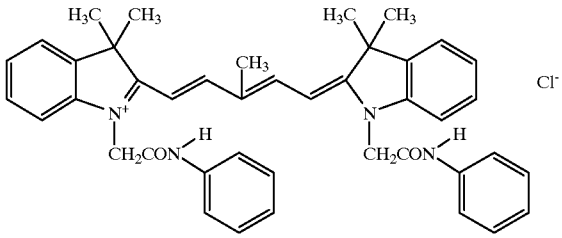
(23)
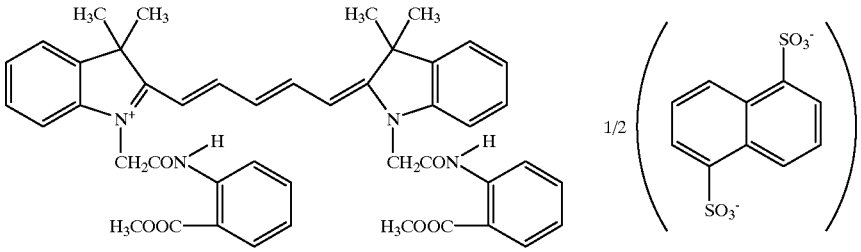
(24)
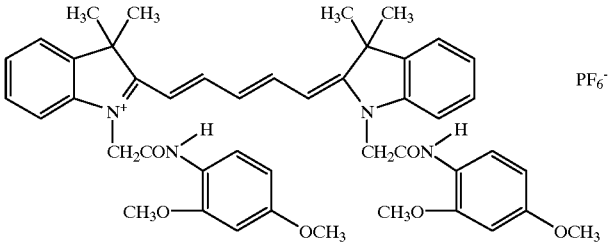
(25)
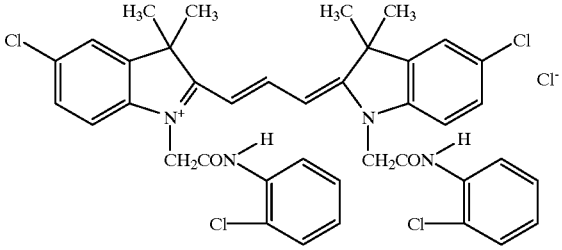
(26)
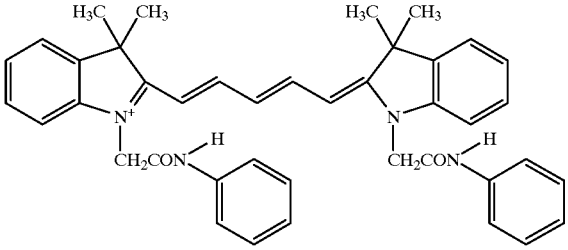
(27)
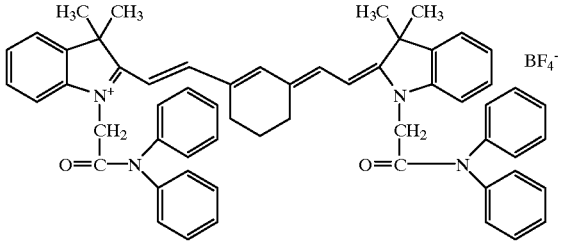

-continued
(28)
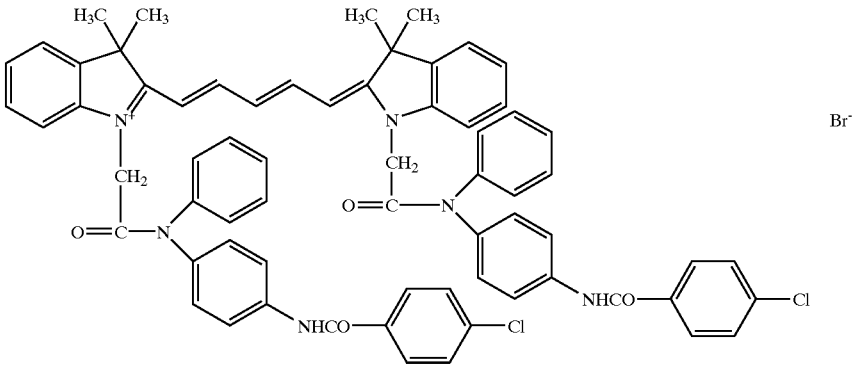
(29)
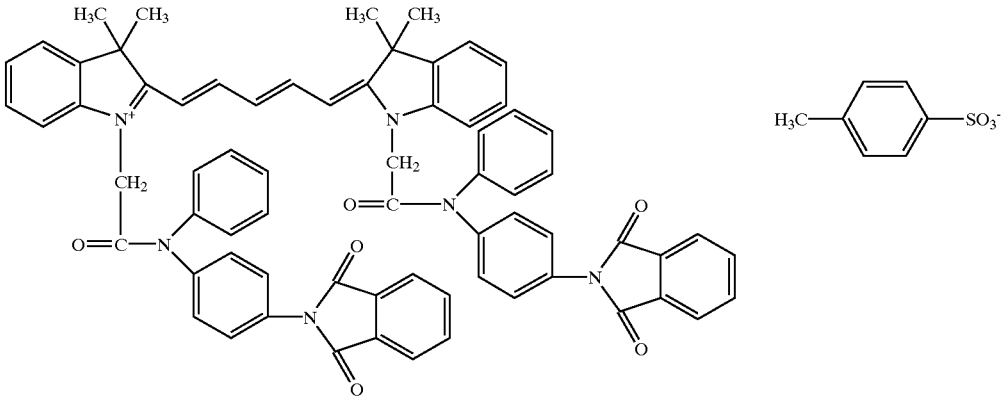
(30)
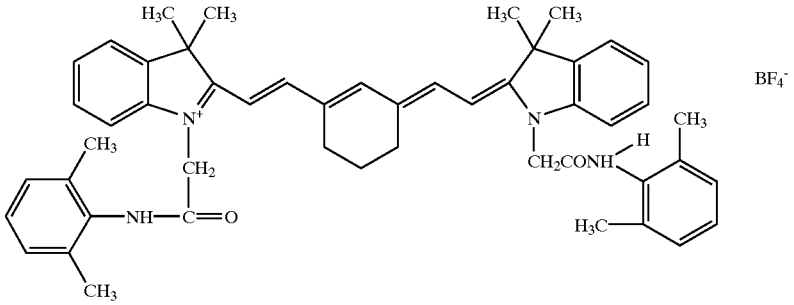
(31)
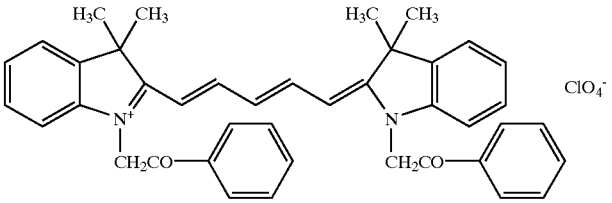
(32)
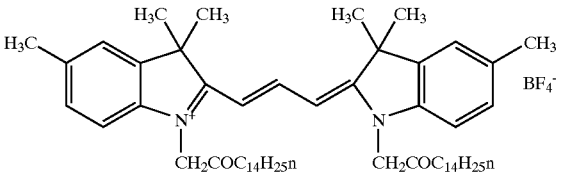
(33)
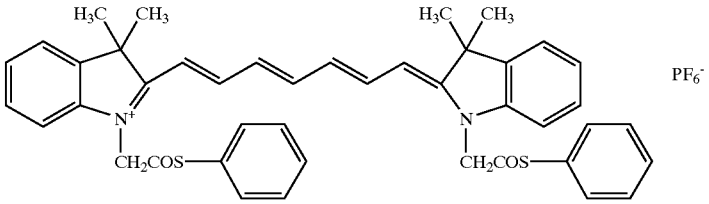

-continued
(34)
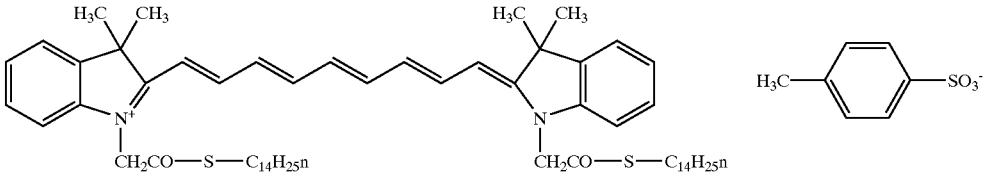
(35)
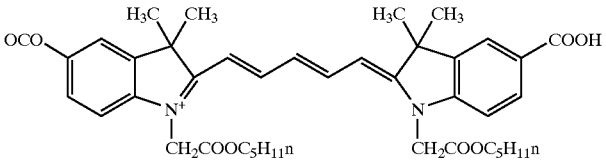
(36)
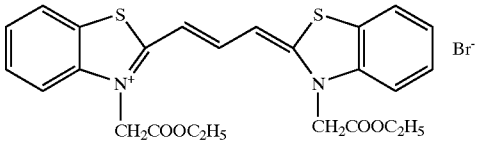
(37)
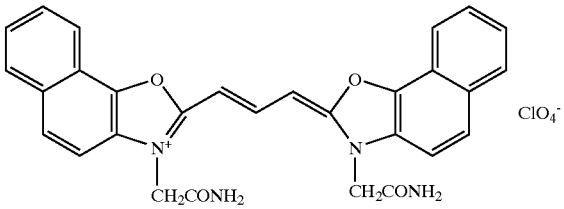
(38)
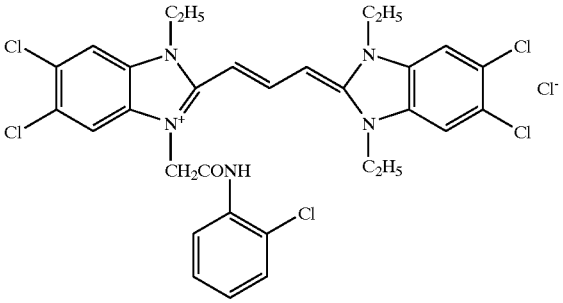
(39)
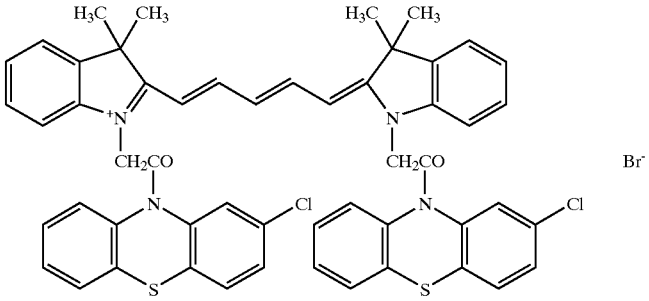
(40)
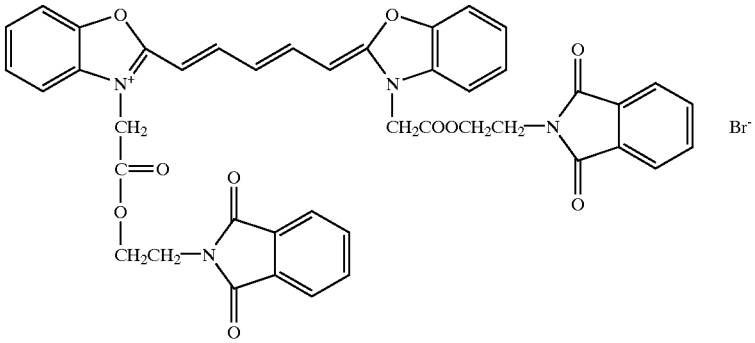
(41)
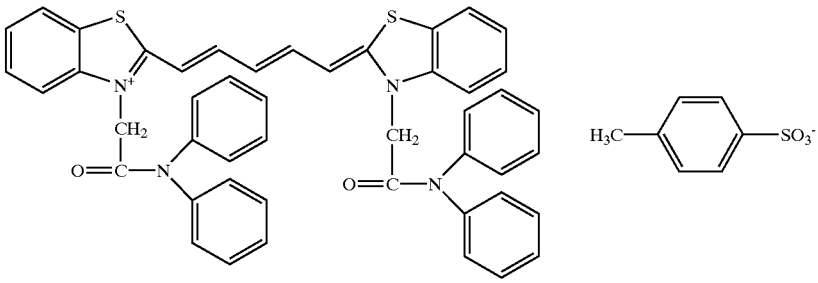

-continued (42)

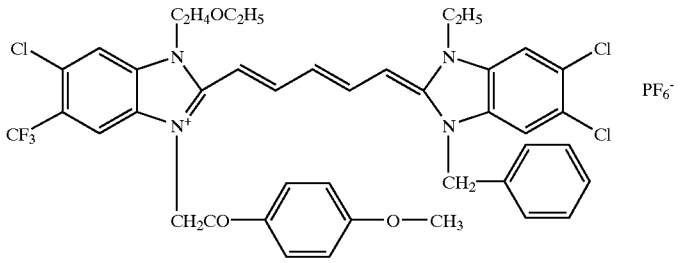

The above dyes and other cyanine dyes can be synthesized referring to the methods disclosed in JP-A-62-123454 and JP-A-7-333784.

SYNTHESIS EXAMPLE 1

Synthesis of Cyanine Dye (1)

A mixed solution comprising 33.4 g of ethyl bromoacetate, 15.9 g of 2,3,3-trimethylindolenine and 30 ml of ethanol was refluxed with heating for 5 hours. After completion of the reaction, 50 ml of acetone and 500 ml of ethyl acetate were added thereto, and quaternary salt precipitated was filtered out. Yield of the quaternary salt was 25.4 g, and the melting point was 250° C. or more.

A mixed solution comprising 16.3 g of the quaternary salt, 4.9 g of tetramethoxypropane, 75 g of N-methylpyrrolidone, 2.85 g of acetic acid and 19.0 g of acetic anhydride was heated at 50° C. for 3 hours. After completion of the reaction, 50 ml of water was added thereto and, after crystals precipitated were filtered out, the filtrate was recrystallized with methanol/isopropanol/ethyl acetate. Yield: 13.1 g, melting point: 250° C. or more, λmax: 637.5 nm, ε: $2.16\times10^5$ (methanol).

The dye which can be bleached with a base according to the present invention (the salt thereof is also included, hereinafter sometimes referred to as "an achromatic dye") is a compound which can be achromatized with the influence of a base under heating. Those which form substantially a colorless 5- or 7-membered ring compound by an intramolecular nucleophilic reaction can be exemplified as such dyes. For example, when the foregoing dye represented by formula (I) is subjected to the action of a base under a heating condition, a 5- or 7-membered ring compound is formed by $CHR^1R^2$, $CR^3$ and $CR^4$, thereby the conjugate property is cut out and the dye becomes substantially colorless.

The 5- or 7-membered ring compound to be formed is substantially a colorless and stable compound, which does not return to the initial dye or the achromatized substance does not restore its color.

Various base precursors can be used in the present invention, but as an achromatic reaction is performed under a heating condition, it is preferred to use a precursor which forms (or releases) a base by heating. As a base precursor which forms a base by heating, a thermal decomposition type (decarboxylation type) base precursor comprising a salt of a carboxylic acid with a base is representative. When a decarboxylation type base precursor is heated, the carboxyl group of the carboxylic acid generates a decarboxylation reaction and an organic base is released. As carboxylic acids, a sulfonylacetic acid and a propiolic acid which are liable to be decarboxylated are used. It is preferred for a sulfonylacetic acid and a propiolic acid to have, as a substituent, a group having an aromaticity (an aryl group or an unsaturated heterocyclic group) which accelerates decarboxylation. Base precursors of sulfonylacetate are disclosed in JP-A-59-168441 and base precursors of propiolate are disclosed in JP-A-59-180537, respectively.

As the component of the base side of a decarboxylation type base precursor, organic bases are preferably used, more preferably amidine, guanidine or derivatives thereof. Organic bases are preferably diacidic bases, triacidic bases or tetraacidic bases, more preferably diacidic bases, and most preferably diacidic bases of amidine derivatives or guanidine derivatives.

Precursors of diacidic bases, triacidic bases or tetraacidic bases of amidine derivatives are disclosed in JP-B-7-59545, and precursors of diacidic bases, triacidic bases or tetraacidic bases of guanidine derivatives are disclosed in JP-B-8-10321.

Diacidic bases of amidine derivatives or guanidine derivatives comprise (A) two amidine moieties or guanidine moieties, (B) substituents of amidine moieties or guanidine moieties, and (C) a divalent linking group for linking two amidine moieties or guanidine moieties. Examples of (B) substituents include an alkyl group (including a cycloalkyl group), an alkenyl group, an alkynyl group, an aralkyl group and a heterocyclic ring residue. Two or more substituents may be bonded to form a nitrogen-containing heterocyclic ring. (C) Linking group is preferably an alkylene group or a phenylene group.

Examples of diacidic base precursors of amidine derivatives or guanidine derivatives are shown below.

(BP-1)

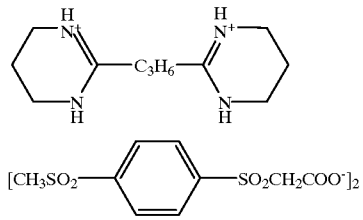

(BP-2)

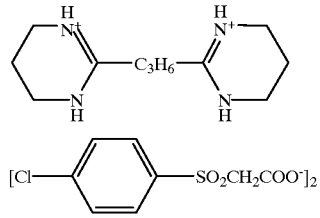

-continued
(BP-3)
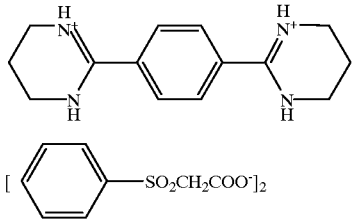
(BP-4)
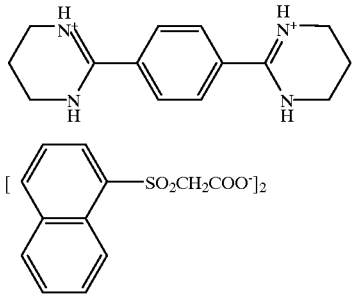
(BP-5)
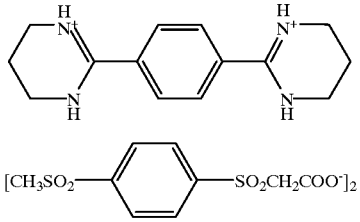
(BP-6)
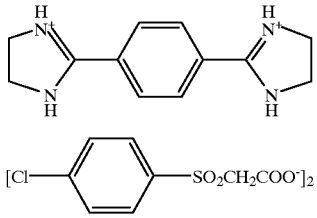
(BP-7)
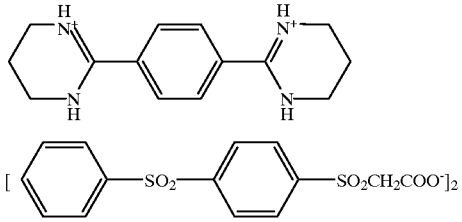
(BP-8)
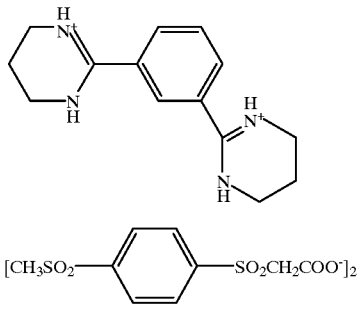
-continued
(BP-9)
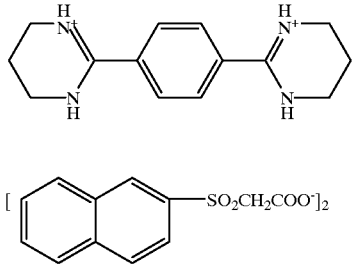
(BP-10)
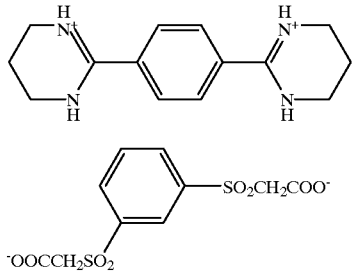
(BP-11)
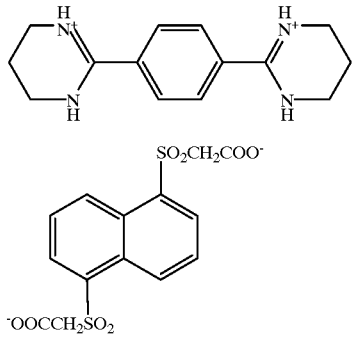
(BP-12)
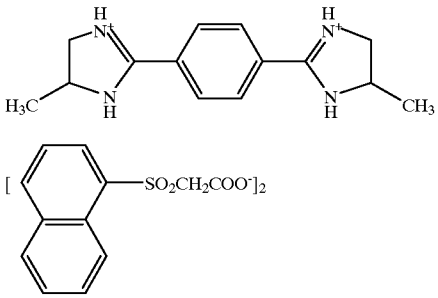
(BP-13)
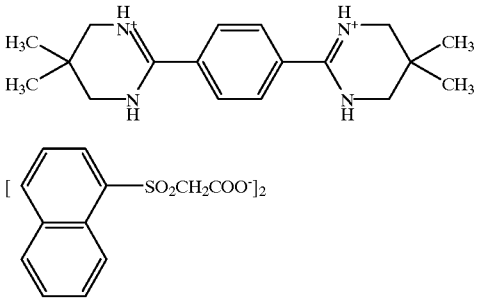

-continued
(BP-14)
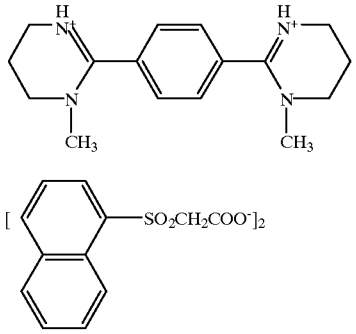
(BP-15)
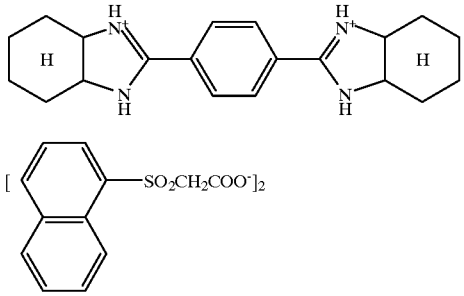
(BP-16)
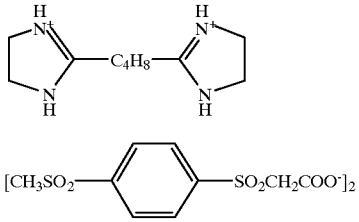
(BP-17)
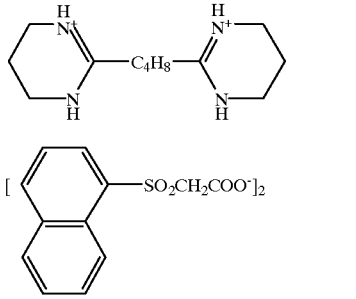
(BP-18)
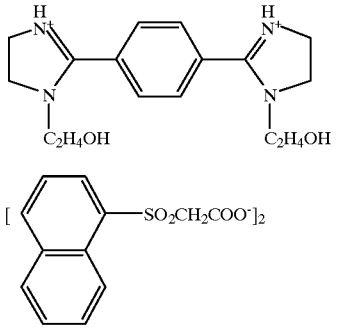
-continued
(BP-19)
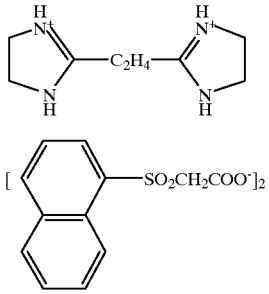
(BP-20)
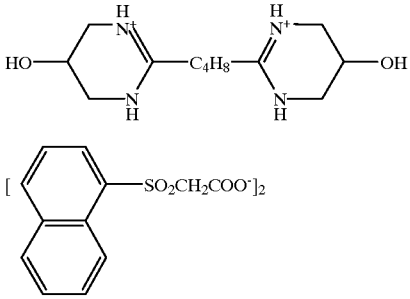
(BP-21)
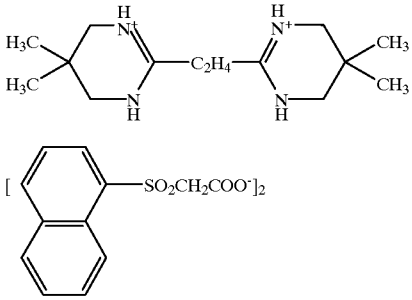
(BP-22)
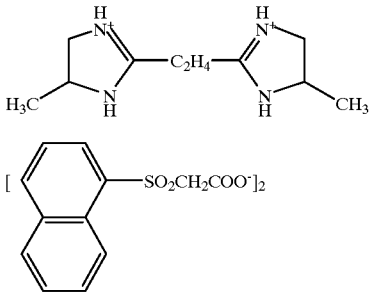
(BP-23)
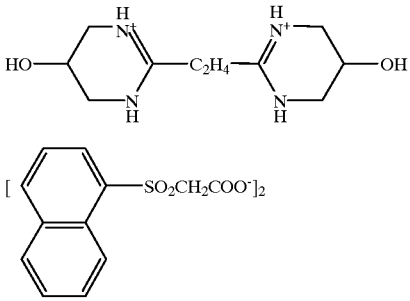

-continued
(BP-24)
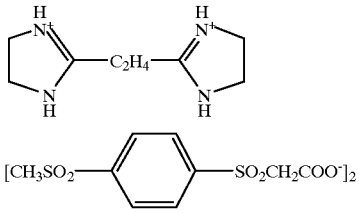
(BP-25)
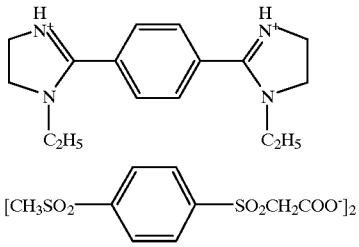
(BP-26)
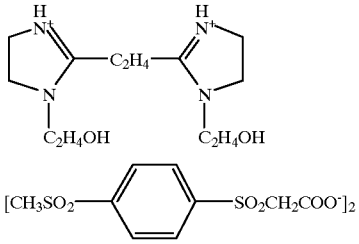
(BP-27)
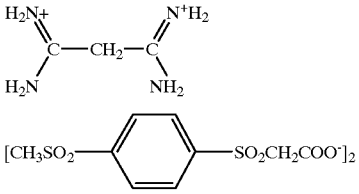
(BP-28)
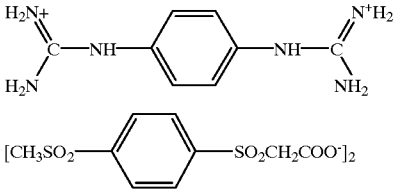
(BP-29)
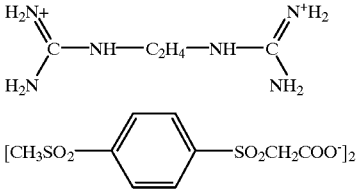
(BP-30)
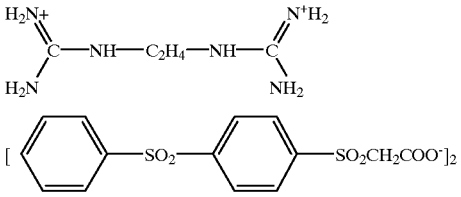
-continued
(BP-31)
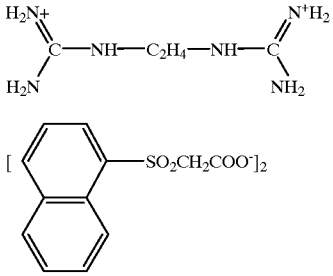
(BP-32)
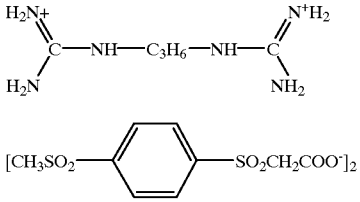
(BP-33)
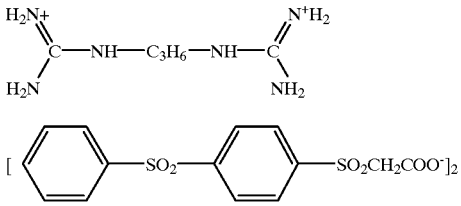
(BP-34)
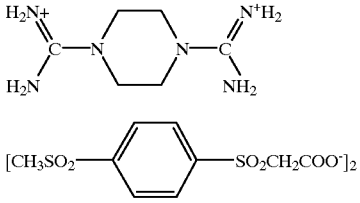
(BP-35)
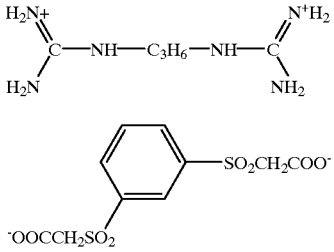
(BP-36)
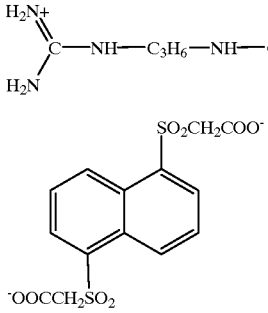

-continued (BP-37)

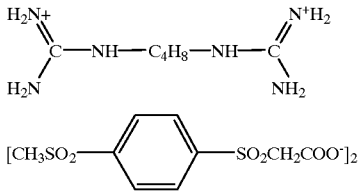

(BP-38)

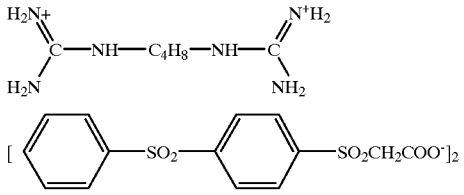

(BP-39)

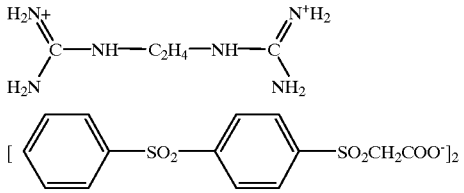

The use amount of base precursors (mol) is preferably from 1 to 100 times of the amount of achromatic dyes (mol), more preferably from 3 to 30 times.

In the present invention, melting point depressants can be used as an accelerator of dye bleaching by a base precursor. Melting point depressants are compounds to make the melting point of the mixture with a base precursor lower than the melting point of the base precursor alone, preferably lower by 3 to 20° C., and still more preferably lower by 5 to 15° C. Variation of melting points can be observed by mixing two kinds of powders, i.e., a base precursor and a melting point depressant, in a mortar and performing measurement of samples by differential scanning calorimeter (DSC).

Two or more melting point depressants may be used at the same time in combination.

Melting point depressants which are used for such a purpose are not particularly limited so long as they are compounds satisfying the foregoing condition. Melting point depressants having the same or higher melting point than that of a base precursor are preferably used, more preferably those having a melting point of from 50 to 200° C., and still more preferably from 70 to 150° C. A base precursor and a melting point depressant can be mixed in an arbitrary ratio. Melting point depressants stable to bases are more preferred.

As compounds satisfying these conditions, compounds which are used in general as a thermal solvent can be used. Specific examples include, e.g., waxes (e.g., paraffin wax, microcrystalline wax, fatty acid amide wax, stearic acid amide, ethylenebisstearoamide), amides (e.g., benzamide, N-methylbenzamide, fatty acid amide, acetoacetic acid anilide), sulfonamides (e.g., p-toluenesulfonamide, N-methyl-benzenesulfonamide), carboxylates (e.g., phenyl benzoate, dimethyl terephthalate, diphenyl phthalate), aryl nitriles, phenol derivatives (e.g., 2,6-di-tert-butyl-4-methylphenol, 2,2'-dihydroxy-4,4'-dimethoxybenzophenone), naphthol derivatives (e.g., benzyl-1-naphthyl ether, phenoxyacetic acid-2-naphthyl ester), alcohols (e.g., sorbitol), urea derivatives (e.g., N-methylurea, N-phenylurea, N,N-dimethyl-N'-phenylurea), urethanes (e.g., phenylcarbamoyloxydecane, p-tolyl-carbamoyloxybenzene), substituted biphenyls (e.g., 4-(2-phenylethoxy)biphenyl, biphenylphenylmethane, 4-acetyloxybiphenyl), ethers (e.g., 1,2-diphenoxyethane, 1,4-bis(p-tolyloxy)butane), thioethers (e.g., 1,2-bis(p-methoxy-phenylthio)ethane), aromatic hydrocarbons (e.g., bibenzyl, biphenyl, triphenylmethane), benzotriazole derivatives (e.g., 2-(2'-hydroxy-5'-methylphenyl) benzotriazole, 2-(2'-hydroxy-4', 6'-di-tert-pentylphenyl) benzotriazole), and sulfones (e.g., diphenylsulfone, bis(4-chlorophenyl)sulfone, 4-chlorophenyl(phenyl)sulfone, 4-(phenylsulfonyl)phenylsulfonylmethane, methanesulfonylbenzene).

Of these, amides, phenol derivatives, naphthol derivatives, benzotriazole derivatives, and sulfones are more preferred and sulfones are most preferred.

A melting point depressant is preferably used in an amount of from 1 wt % to 500 wt %, more preferably from 5 wt % to 200 wt %, based on the base precursor.

In the present invention, it is preferred that achromatic dyes and base precursors are added to the photosensitive layer of a photothermographic photosensitive material to make the photosensitive layer function as a filter layer or an antihalation layer. A photothermographic photosensitive material has in general a photoinsensitive layer in addition to a photosensitive layer. A photoinsensitive layer can be classified from its arrangement into (1) a protective layer provided on the photosensitive layer (farther side from the support), (2) an interlayer provided between a plurality of photosensitive layers or between a photosensitive layer and a protective layer, (3) an undercoating layer provided between a photosensitive layer and a support, and (4) a backing layer provided on the side opposite to the side on which a photosensitive layer is provided. A filter layer is provided on a photosensitive material as a layer (1) or (2). An antihalation layer is provided on a photosensitive material as a layer (3) or (4).

Achromatic dyes and base precursors are preferably added to the same photoinsensitive layer. However, they may be added to adjacent two photoinsensitive layers separately. A barrier layer may be provided between two photoinsensitive layers. The terminology "achromatic dyes and base precursors are contained in a layer" used in this specification includes the case when achromatic dyes and base precursors are contained in a plurality of adjacent layers separately As addition methods of achromatic dyes to a photoinsensitive layer, methods of adding the solution, emulsion, solid fine particle dispersion or polymer impregnated substance of achromatic dyes to the coating solution of a photoinsensitive layer can be used. Achromatic dyes may also be added to a photoinsensitive layer by using a polymer mordant. These addition methods are the same as the method of adding dyes to an ordinary heat-developing photosensitive material. The latexes for use in polymer impregnation are disclosed in U.S. Pat. No. 4,199,363, German Patents 25,141,274, 2,541,230, European Patent No. 029104 and JP-B-53-41091. An emulsifying method of adding dyes to a polymer solution is disclosed in WO 88/00723.

The addition amount of achromatic dyes are determined by the use of the dyes. In general, achromatic dyes are used in such an amount as optical density (absorbance) exceeds 0.1 when measured at an objective wavelength. Optical density is preferably from 0.2 to 2. The addition amount of the dye for obtaining such optical density is in general from 0.001 to 1 g/m$^2$ or so, preferably from 0.005 to 0.8 g/m$^2$ or so, and particularly preferably from 0.01 to 0.2 g/m$^2$ or so.

When a dye is achromatized according to the present invention, optical density can be reduced to 0.1 or less. Two or more achromatic dyes may be used in combination in a photothermographic photosensitive material according to the present invention. Two or more base precursors may also be used in combination.

A single side photosensitive material according to the present invention contains a matting agent having a softening point of from 100 to 500° C. at least on one side of a support and, at the same time, other matting agents may be used in a surface protective layer and/or a backing layer of a photosensitive emulsion layer. Matting agents in general comprise fine particles of water-insoluble organic or inorganic compounds. Optional matting agents can be used in the present invention. Organic matting agents disclosed in U.S. Pat. Nos. 1,939,213, 2,701,245, 2,322,037, 3,262,782, 3,539,344, 3,767,448, and inorganic matting agents disclosed in U.S. Pat. Nos. 1,260,772, 2,192,241, 3,257,206, 3,370,951, 3,523,022 and 3,769,020 are well-known in this industry and can be used in the present invention. As specific examples of organic compounds which can be used as matting agents, water-dispersible vinyl polymers such as polymethyl acrylate, polymethyl methacrylate, polyacrylonitrile, acrylonitrile-α-methylstyrene copolymers, polystyrene, styrene/divinylbenzene copolymers, polyvinyl acetate, polyethylene carbonate, polytetrafluoroethylene, etc., cellulose derivatives such as methyl cellulose, cellulose acetate, cellulose acetate propionate, etc., starch derivatives such as carboxyl starch, carboxynitrophenyl starch, urea/formaldehyde/starch reaction products, etc., hardened gelatin treated with well-known hardening agents, and hardened gelatin as microencapsulated hollow product by coacervation hardening can be preferably used. As examples of inorganic compounds, silicon dioxide, titanium dioxide, magnesium dioxide, aluminum oxide, barium sulfate, calcium carbonate, silver chloride and silver bromide desensitized by a well-known method, glass, and diatomaceous earth can be preferably used. These matting agents can be mixed with different kinds of substances, if necessary. The size and shape of the matting agent are not particularly limited and optional diameters can be selected. In the present invention, matting agents having a particle size of from 0.1 μm to 30 μm can be preferably used. The particle size distribution of the matting agent may be broad or narrow. On the other hand, as matting agents largely affect the haze of the coated film and the surface gloss, it is desired to adjust particle size, particle shape and particle size distribution to a necessary condition when matting agents are prepared or by mixing a plurality of matting agents.

The heat-developable photographic emulsion according to the present invention is contained in one or more layers on a support. One layer constitution must contain an organic silver salt, a silver halide, a reducing agent, and a binder, in addition to these, desired additional materials, e.g., a toning agent, a covering aid, and other auxiliary agents. Two layer constitution must contain an organic silver salt and a silver halide in the first emulsion layer (generally a layer adjacent to a support), and other several components in the second emulsion layer, or in both the first and second layers. There is another two layer constitution comprising a single emulsion layer containing all the components and a protective top coating layer, however. In the constitution of a multi-color photosensitive heat-developable photographic material, each color may comprise a combination of these two layers. Alternatively, as disclosed in U.S. Pat. No. 4,708,928, a single layer may contain all the components. In the case of a multi-dye multi-color photosensitive heat-developable photographic material, in general, a functional or non-functional barrier layer is provided between each emulsion layer (a photosensitive layer) to separate and retain each emulsion layer as disclosed in U.S. Pat. No. 4,460,681.

A backside resistive heating layer disclosed in U.S. Pat. Nos. 4,460,681 and 4,374,921 can also be used in the photothermographic photosensitive photographic image-forming material in the present invention.

The photographic emulsion for photothermographic development according to the present invention can be coated on various supports. Representative examples of the supports include polyester films, undercoated polyester films, poly(ethylene terephthalate) films (PET films), polyethylene naphthalate films, cellulose nitrate films, cellulose ester films, poly(vinyl acetal) films, polycarbonate films, and related materials or resinous materials, glass, paper, and metal. Flexible substrates, in particular, paper supports coated with baryta and/or partially acetylated α-olefin polymers, in particular, α-olefin polymers having from 2 to 10 carbon atoms such as polyethylene, polypropylene, ethylene/butene copolymer, are typically used in the present invention. Support may be transparent or translucent but is preferably transparent. Of these supports, biaxially stretched polyethylene terephthalate having a thickness of from 100 to 200 μm or so is particularly preferred.

The photosensitive material according to the present invention may be provided with an electrically conductive layer, e.g., layers containing soluble salts (e.g., chloride, nitrate), metal deposited layers, layers containing ionic polymers disclosed in U.S. Pat. Nos. 2,861,056 and 3,206,312, and insoluble inorganic salts disclosed in U.S. Pat. No. 3,428,451 for the purpose of static prevention. Further, a support can be dyed, if necessary.

The method for obtaining color images with the photothermographic photosensitive material according to the present invention is disclosed in JP-A-7-13295, from p. 10, left column, 1. 43 to p. 11, left column, 1. 40. Color dye image stabilzers are disclosed in British Patent 1,326,889, U.S. Pat. Nos. 3,432,300, 3,698,909, 3,574,627, 3,573,050, 3,764,337 and 4,042,394.

The photographic emulsion for heat development according to the present invention can be coated by any method. For example, immersion coating, air knife coating, flow coating, and various coating methods including extrusion coating using hoppers disclosed in U.S. Pat. No. 2,681,294 can be used. Two or more layers (for example, a combination of an emulsion layer and a surface protective layer) can be coated simultaneously by the methods disclosed in U.S. Pat. No. 2,761,791 and British Patent 837,095, if desired.

The photothermographic photosensitive material according to the present invention can include other additional layers, e.g., a dye-receiving layer for receiving transfer dye images, an opaque layer for the time when reflective printing is desired, a protective top coating layer, and a primer layer which is known in photothermographic photographic techniques. The photosensitive material according to the present invention is preferred in that image formation is feasible with that photosensitive material only and a functional layer such as an image-receiving layer which is necessary for image formation requires no different photosensitive material.

The photosensitive material according to the present invention can be exposed by any method, e.g., well-known methods using a tungsten lamp, a mercury lamp, a laser right source, a CRT light source, a xenon lamp, an iodide lamp, etc., can be used. Of these, a method of using a laser right source is particularly preferably used.

The photothermographic photosensitive material according to the present invention shows low haze by exposure and interference fringe is liable to be generated. A technique of letting laser beams in aslant to the photosensitive material as disclosed in JP-A-5-113548 and a method of using a multimode laser as disclosed in WO 95/31754 are known techniques to prevent generation of interference fringe. These techniques are preferably used in the present invention.

For exposing the photothermographic photosensitive material according to the present invention, it is preferred to perform exposure in such a manner that laser beams are overlapped so as to hide scanning lines as disclosed in *SPIE*, Vol. 169, "Laser Printing", pp. 116 to 128 (1979), JP-A-4-51043 and WO 95/31754.

The present invention is described in detail with reference to the examples.

EXAMPLE I

Preparation of Silver Halide Emulsion 1

To 1,421 ml of distilled water was added 6.7 ml of a 1 wt % potassium bromide solution, further 8.2 ml of 1 N nitric acid and 21.8 g of phthalated gelatin were added. This mixed solution was stirred in a titanium-coated stainless reaction vessel with maintaining the temperature at 37° C. Solution A (37.04 g of silver nitrate was diluted with distilled water to make 159 ml) and solution B (32.6 g of potassium bromide was diluted with distilled water to make 200 ml) were prepared. The entire amount of solution A was added to the reaction vessel at a constant flow rate by a controlled double jet method with maintaining pAg at 8.1 over 1 minute (solution B was added by a controlled double jet method). Then, 30 ml of a 3.5 wt % hydrogen peroxide aqueous solution was added, further, 36 ml of a 3 wt % aqueous solution of compound 1 was added. Solution A2 (solution A was again diluted with distilled water to make 317.5 ml) and solution B2 (compound 2 was dissolved in solution B so as to make the concentration $1\times10^{-4}$ mol per mol of the silver, diluted with distilled water to reach the final volume of 2 times of solution B, i.e., 400 ml) were prepared. The entire amount of solution A2 was added to the reaction vessel at a constant flow rate by a controlled double jet method with maintaining pAg at 8.1 over 10 minutes (solution B2 was added by a controlled double jet method). Then, 50 ml of a 0.5 wt % methanol solution of compound 3 was added, further, pAg was lowered to 7.5 with silver nitrate, pH was adjusted with 1 N sulfuric acid to 3.8, and stirring was stopped. The reaction solution was subjected to precipitation, desalting and washing processes, 3.5 g of deionized gelatin was added, and 1 N sodium hydroxide was added to adjust pH to 6.0 and pAg to 8.2, thereby a silver halide dispersion was obtained.

The grains in the thus-prepared silver halide emulsion were pure silver bromide grains having an average equivalent-sphere diameter of 0.04 $\mu$m and equivalent-sphere variation coefficient of 11%. Grain size was average of 1,000 grains obtained by electron microscope. {100} Plane ratio of this grain was 85% according to the Kubelka-Munk method.

The temperature of the above emulsion was raised to 50° C. with stirring, then 5 ml of a 0.5 wt % solution of compound 4 and 5 ml of a 3.5 wt % solution of compound 5 were added thereto, and 1 minute after, $3\times10^{-5}$ mol per mol of the silver of compound 6 was added. Further 2 minutes after, a solid dispersion of spectral sensitizing dye A (a gelatin aqueous solution) was added in an amount of $5\times10^{-3}$ mol per mol of the silver, and further 2 minutes after, $5\times10^{-5}$ mol per mol of the silver of a tellurium sensitizer B was added and the reaction solution was subjected to ripening for 50 minutes. Immediately before completion of ripening, compound 3 was added in an amount of $1\times10^{-3}$ mol per mol of the silver. The temperature was lowered and chemical sensitization was terminated. Thus, silver halide emulsion 1 was prepared.

Compound 1

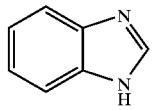

Compound 2

$K_3IrCl_6^-$

Compound 3

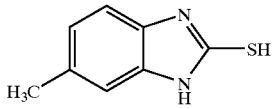

Compound 4

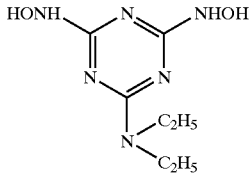

Compound 5

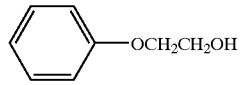

Compound 6

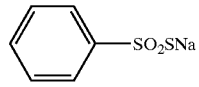

Spectral Sensitizing Dye A

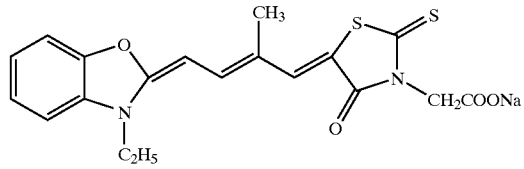

Tellurium Sensitizer B

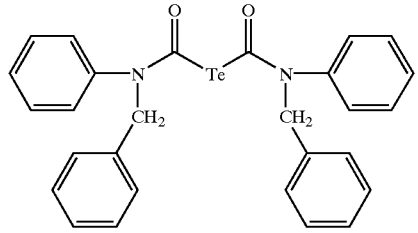

Preparation of Silver Halide Emulsion 2

Phthalated gelatin (22 g) and 30 mg of potassium bromide were dissolved in 700 ml of water, pH was adjusted to 5.0 at 40° C. An aqueous solution (159 ml) containing 18.6 g of silver nitrate and an aqueous solution of potassium bromide were added to the foregoing solution by a controlled double jet method over 10 minutes with maintaining pAg at 7.7.

Subsequently, 476 ml of an aqueous solution containing 55.4 g of silver nitrate and an aqueous solution containing 8 μmol/liter of dipotassium hexachloroiridate and 1 mo/liter of potassium bromide were added to the foregoing solution by a controlled double jet method over 30 minutes with maintaining pAg at 7.7. Subsequently, pH was lowered and the reaction solution was subjected to coagulation precipitation, and desalted. Then, 0.1 g of phenoxyethanol was added to adjust pH to 5.9 and pAg to 8.0, thereby the formation of silver iodobromide grains was terminated. The thus-obtained silver halide grains A were cubic grains having an average grain size of 0.08 μm, a variation coefficient of the projected area diameter of 8%, and {100} plane ratio of 86%.

The temperature of the thus-obtained silver halide grains A was raised to 60° C. Sodium thiosulfate (85 μmol), 11 μmol of 2,3,4,5,6-pentafluorophenyldiphenylphosphineselenide, 2 μmol of tellurium sensitizer B, 3.3 μmol of chloroauric acid, and 230 μmol of thiocyanic acid, each per mol of the silver, were added to the above silver halide grains and ripened for 120 minutes, then the temperature was lowered to 40° C. Spectral sensitizing dye A in an amount of $3.5\times10^{-4}$ mol and 2-mercapto-5-methylbenzimidazole in an amount of $4.6\times10^{-3}$ mol were added thereto with stirring and the reaction solution was then stirred for 10 minutes. The temperature was then rapidly cooled to 25° C. to thereby obtain silver halide emulsion 2.

Preparation of Organic Silver Salt Dispersion While stirring 43.8 g of behenic acid (manufactured by Henkel Co., trade name: Edenor C22-85R), 730 ml of distilled water, and 60 ml of butanol at 79° C., 117 ml of 1 N NaOH aqueous solution was added thereto over 55 minutes and the mixture was allowed to reaction for 240 minutes. Then, 112.5 ml of an aqueous solution containing 19.2 g of silver nitrate was added thereto over 45 seconds and the solution was allowed to stand for 20 minutes, and then the temperature was lowered to 30° C. The solid content was then filtered by suction. The solid content was washed with water until the conductivity of the filtrate reached 30 μS/cm. The thus-obtained solid content was not dried and treated as a wet cake. Seven point four (7.4) grams of polyvinyl alcohol (trade name: PVA-205) and water were added to the wet cake of the amount corresponding to 100 g of dried solid content to make the entire amount 385 g, and then preliminarily dispersed in a homomixer.

The preliminarily dispersed starting solution was treated three times using a disperser (trade name: Micro-fluidizer M-110S-EH equipped with G10Z interaction chamber, manufactured by Micro Fluidex International Corp.). Pressure of the disperser was adjusted to 1,750 kg/cm$^2$. Thus, silver behenate dispersion B was obtained. Silver behenate grains contained in the thus-obtained silver behenate dispersion were acicular grains having an average short axis length of 0.04 μm, average long axis length of 0.8 μm, and variation coefficient of 30%. Grain size was measured by Master Sizer X (manufactured by Malvern Instruments Ltd.). Coiled heat exchangers were respectively installed before and after the interaction chamber. The desired temperature of dispersion was set by adjusting the temperature of the cooling medium.

Preparation of 25 wt % Dispersion of Reducing Agent

Water (176 g) was added to 75 g of 1,1-bis(2-hydroxy-3,5-dimethylphenyl)-3,5,5-trimethylhexane and 64 g of a 20 wt % aqueous solution of modified polyvinyl alcohol Poval MP203 (manufactured by Kuraray Co., Ltd.), and thoroughly mixed to make a slurry. Zirconia beads (800 g) having an average diameter of 0.5 mm were added to a reaction vessel with the above-obtained slurry and dispersed in a disperser (1/4G sand grinder mill, manufactured by Imex Co., Ltd.) for 5 hours, thereby the dispersion of the reducing agent was obtained. The particles of the reducing agent contained in the thus-obtained reducing agent dispersion had an average diameter of 0.69 μm.

Preparation of 20 wt % Dispersion of Mercapto Compound

Water (224 g) was added to 60 g of 3-mercapto-4-phenyl-5-heptyl-1,2,4-triazole and 32 g of a 20 wt % aqueous solution of modified polyvinyl alcohol Poval MP203 (manufactured by Kuraray Co., Ltd.), and thoroughly mixed to make a slurry. Zirconia beads (800 g) having an average diameter of 0.5 mm were added to a reaction vessel with the above-obtained slurry and dispersed in a disperser (1/4G sand grinder mill, manufactured by Imex Co., Ltd.) for 10 hours, thereby the dispersion of the mercapto compound was obtained. The particles of the mercapto compound contained in the thus-obtained mercapto compound dispersion had an average particle diameter of 0.65 μm.

Preparation of 30 wt % Dispersion of Organic Polyhalogen Compound

Water (224 g) was added to 40 g of tribromomethylphenylsulfone, 48 g tribromomethylsulfonyl-4-phenyl-5-tridecyl-1,2,4-triazole, and 48 g of a 20 wt % aqueous solution of modified polyvinyl alcohol Poval MP203 (manufactured by Kuraray Co., Ltd.), and thoroughly mixed to make a slurry. Zirconia beads (800 g) having an average diameter of 0.5 mm were added to a reaction vessel with the above-obtained slurry and dispersed in a disperser (1/4G sand grinder mill, manufactured by Imex Co., Ltd.) for 5 hours, thereby a dispersion of the organic polyhalogen compound was obtained. The particles of the organic polyhalogen compound contained in the thus-obtained polyhalogen compound dispersion had an average particle diameter of 0.75 μm.

Preparation of 10 wt % Methanol Solution of Phthalazine Compound

6-Isopropylphthalazine (10 g) was dissolved in 90 g of methanol and used.

Preparation of 20 wt % Dispersion of Pigment

Water (250 g) was added to 64 g of C.I. Pigment Blue 60 and 6.4 g of Demole N (manufactured by Kao Corporation), and thoroughly mixed to make a slurry. Zirconia beads (800 g) having an average diameter of 0.5 mm were added to a reaction vessel with the above-obtained slurry and dispersed in a disperser (1/4G sand grinder mill, manufactured by Imex Co., Ltd.) for 25 hours, thereby the dispersion of the pigment was obtained. The particles of the pigment contained in the thus-obtained pigment dispersion had an average particle diameter of 0.25 μm.

Preparation of 40 wt % SBR Latex

SBR latex shown below was diluted with distilled water to 10 times, and purified by module FS03-FC-FUY03A1 for ultrafiltration purification (Daisen Membrane System Co., Ltd.) until the ionic conductivity becomes 1.5 mS/cm. The concentration of the latex at this time was 40 wt %.

SBR Latex: Latex of -St (68)-Bu (29)-AA (3)-

Average particle size: 0.1 μm

Equilibrium moisture content at 25° C. 60% RH: 0.6 wt %

Concentration: 45 wt %

Ionic conductivity: 4.2 mS/cm pH: 8.2

Ionic conductivity was measured using a conductometer CM-30S (manufactured by Toa Denpa Kogyo Co., Ltd., starting solution of the latex (40 wt %) was measured at 25° C.

Preparation of Coating Solution for Emulsion Layer

Coating Solution No. 1 for Emulsion Layer

The above-obtained organic acid silver dispersion (103 g), 5 g of a 20 wt % aqueous solution of polyvinyl alcohol PVA-205 (manufactured by Kuraray Co., Ltd.), 23.2 g of the above-prepared 25 wt % reducing agent dispersion, 1.1 g of the above 20 wt % water dispersion of pigments, 10.7 g of the 30 wt % dispersion of organic polyhalogen compound, and 3.1 g of the 20 wt % dispersion of mercapto compound, 106 g of the 40 wt % SBR latex purified by ultrafiltration, 6 ml of a solution of a phthalazinone compound, 5 g of silver halide emulsion 1, and 5 g of silver halide emulsion 2 were thoroughly mixed to thereby prepare an emulsion layer coating solution. This coating solution was coated in a coating amount of 65 ml/m$^2$.

The above emulsion layer coating solution was revealed to have viscosity of 85 (mPa·s) at 40° C. (No. 1 rotor) measured by Model B viscometer (manufactured by Tokyo Keiki Co., Ltd.). The viscosity of the coating solution measured by RFS Fluid Spectrometer (manufactured by Rheometrics Far East Co.) at 25° C. was 1,500, 220, 70, 40, 20 (mPa·s) at shear rate of 0.1, 1, 10, 100, 1,000 (1/sec), respectively.

Preparation of Interlayer Coating Solution

To 772 g of polyvinyl alcohol PVA-205 (manufactured by Kuraray Co., Ltd.) and 226 g of a 27.5 wt % solution of latex of methyl methacrylate/styrene/2-ethylhexyl acrylate/hydroxyethyl methacrylate/acrylic acid copolymer (copolymerization weight ratio: 59/9/26/5/1) was added 2 ml of a5 wt % aqueous solution of Aerosol OT (manufactured by American Cyanamide Co.) to make an interlayer coating solution. The coating solution was coated on the emulsion layer in a coating amount of 5 ml/m$^2$. The viscosity of the coating solution was 21 (mPa·s) at 40° C. (No. 1 rotor) measured by Model B viscometer.

Preparation of First Protective Layer Coating Solution of Emulsion Surface

First Protective Layer Coating Solution

Inert gelatin (80 g) was dissolved in water, and 64 ml of a 10 wt % methanol solution of phthalic acid, 74 ml of a 10 wt % aqueous solution of 4-methylphthalate, 28 ml of 1 N sulfuric acid, and 5 ml of a 5 wt % aqueous solution of Aerosol OT (manufactured by American Cyanamide Co.) were added thereto. Water was added to make the total amount 1,000 g, thereby a first protective layer coating solution was obtained. The coating solution was coated on the interlayer in coating amount of 10 ml/m$^2$.

The viscosity of the coating solution was 18 (mPa·s) at 40° C. (No. 1 rotor) measured by Model B viscometer.

Preparation of Second Protective Layer Coating Solution of Emulsion Surface

Second Protective Layer Coating Solution

Inert gelatin (100 g) was dissolved in water, and 20 ml of a 5% solution of potassium N-perfluorooctylsulfonyl-N-propylalanine, 16 ml of a 5 wt % aqueous solution of Aerosol OT (manufactured by American Cyanamide Co.), 25 g of polymethyl methacrylate fine particles (average particle size: 4.0 μm), 1.4 g of phthalic acid, 1.6 g of 4-methylphthalate, 44 ml of 1 N sulfuric acid, and 445 ml of a 4 wt % of chrome alum were added thereto. Water was added to make the total amount 2,000 g, thereby a second protective layer coating solution was obtained. The coating solution was coated on the first protective layer in coating amount of 10 ml/m$^2$.

The viscosity of the coating solution was 10 (mPa·s) at 40° C. (No. 1 rotor) measured by Model B viscometer.

Preparation of Support

1. Preparation of PET Support

PET having an intrinsic viscosity IV=0.66 (measured in phenol/tetrachloroethane (¾ by weight) at 25° C.) was obtained according to ordinary method with terephthalic acid and ethylene glycol. After the obtained PET was pelletized and dried at 130° C. for 4 hours, melted at 300° C., extruded from T-die, and suddenly cooled, thereby an unstretched film having a film thickness after thermal fixation of 175 μm was obtained.

The film was stretched to 3.3 times in the machine direction with rollers having different peripheral speeds, then 4.5 times in the transverse direction by means of a tenter. The temperatures at that time were 110° C. and 130° C. respectively. Subsequently, the film was subjected to thermal fixation at 240° C. for 20 seconds, then relaxation by 4% in the transverse direction at the same temperature. The chuck part of the tenter was then slit, and both edges of the film were knurled. The film was rolled at 4 kg/cm$^2$, thereby a roll of film having a thickness of 175 μm was obtained.

2. Corona Discharge Treatment of Support Surface

Both surfaces of the support were put under room temperature and corona discharge treatment was performed at 20 m/min with a solid state corona treating apparatus model 6KVA manufactured by Piller Co. From the reading of electric current/voltage, treatment applied to the support at that time was revealed to be 0.375 kV·A·min/m$^2$. The frequency at treatment at that time was 9.6kHz and the gap clearance between the electrode and the dielectric roll was 1.6 mm.

Preparation of Coating Solution A for Undercoating

To 200 ml of polyester copolymer water dispersion Pesresin A-515GB (30 wt %, manufactured by Takamatsu Yushi Co., Ltd.) were added 1 g of polystyrene fine particles (average diameter: 0.2 μm), and 20 ml of Surfactant (7) (1 wt %). Distilled water was added to the above mixture to make the volume 1,000 ml, and this was designated coating solution A for undercoating.

Surfactant (7)

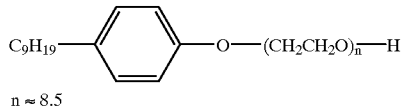

Preparation of Coating Solution B for Undercoating

To 680 ml of distilled water were added 200 ml of styrene/butadiene copolymer water dispersion (styrene/butadiene/itaconic acid=47/50/3 (by weight), concentration: 30 wt %) and 1.1 g of polystyrene fine particles (average particle diameter: 0.4 μm), and further distilled water was added to the above mixture to make the volume 1,000 ml, and this was designated coating solution B for undercoating.

Preparation of Coating Solution C for Undercoating

Ten (10) grams of inert gelatin was dissolved in 500 ml of distilled water, and 40 g of water dispersion of fine particles of stannic oxide/antimony oxide composite (40 wt %) disclosed in JP-A-61-20033 was added thereto. Distilled water was added to the above mixture to make the volume 1,000 ml, and this was designated coating solution C for undercoating.

Preparation of Undercoated Support

On one side (photosensitive layer side) of the above-prepared biaxially stretched polyethylene terephthalate support having a film thickness of 175 μm, the above coating solution A for undercoating was coated by means of a bar coater in a wet coating amount of 5 ml/$M^2$ and dried at 180° C. for 5 minutes. The dry film thickness was about 0.3 μm.

The back surface of this support was subjected to corona discharge treatment, then coating solution B for undercoating was coated by means of a bar coater in a wet coating amount of 5 ml/$m^2$ so as to obtain the dry film thickness of about 0.3 μm, and dried at 180° C. for 5 minutes. Further, coating solution C for undercoating was coated thereon by means of a bar coater in a wet coating amount of 3 ml/$m^2$ so as to obtain the dry film thickness of about 0.03 μm, and dried at 180° C. for 5 minutes. Thus, the undercoated support was prepared.

Preparation of Solid Fine Particle Dispersion Solution (a) of Base Precursor

A base precursor compound (8) (64 g), 28 g of a diphenylsulfone compound (9), and 10 g of surfactant Demole N (manufactured by Kao Corporation) were mixed with 220 ml of distilled water. The mixed solution was dispersed using beads in a sand mill (¼ Gallon sand grinder mill, manufactured by Imex Co., Ltd.), thereby a solid fine particle dispersion solution (a) of the base precursor compound and the diphenylsulfone compound having an average particle size of 0.2 μm was obtained.

Compound (8)

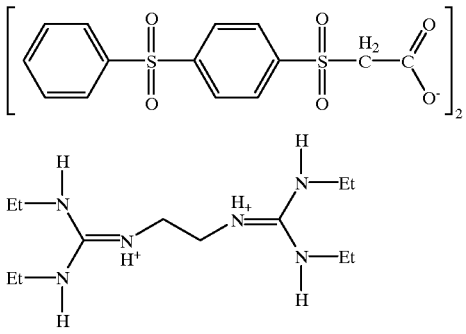

Compound (9)

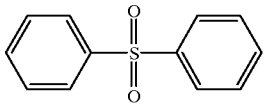

Preparation of Solid Fine Particle Dispersion Solution of Dye

Cyanine dye compound (10) shown below (9.6 g) and 5.8 g of sodium p-alkylbenzenesulfonate were mixed with 305 ml of distilled water. The mixed solution was dispersed using beads in a sand mill (¼ Gallon sand grinder mill, manufactured by Imex Co., Ltd.), thereby a solid fine particle dispersion solution of the dye having an average particle size of 0.2 μm was obtained.

Compound (10)

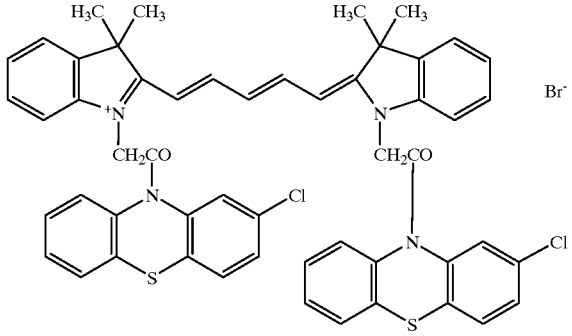

Preparation of Antihalation Layer Coating Solution of Back Surface

Antihalation layer coating solution (a) having the following composition was prepared.

| | | |
|---|---|---|
| 1. | Gelatin | 33 g |
| 2. | Polyacrylamide | 18 g |
| 3. | A 20 wt % solid fine particle dispersion solution base precursor compound (8) | 110 g |
| 4. | A 3 wt % solid fine particle dispersion solution of dye compound (10) | 115 g |
| 5. | Matting agent (the kind and amount are shown in Table 1 below | (Table 1) |
| 6. | Sodium polyethylenesulfonate | 1.5 g |
| 7. | Coloring dye compound (11) shown below | 0.5 g |
| 8. | $H_2O$ | 720 ml |

Compound (11)

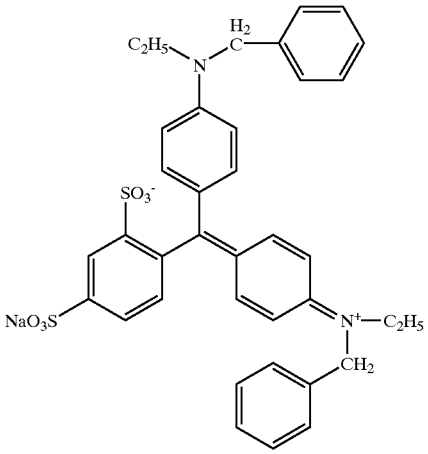

Preparation of Protective Layer Coating Solution of Back Surface

To a reaction vessel maintained at 40° C. were added the following composition and a protective layer coating solution was prepared.

| | | |
|---|---|---|
| 1. | Gelatin | 50 g |
| 2. | Sodium polystyrenesulfonate | 0.2 g |
| 3. | N,N'-ethylenebis (vinylsulfone acetamide) | 2.4 g |

-continued

| | | |
|---|---|---|
| 4. | Sodium t-octylphenoxyethoxyethanesulfonate | 0.8 g |
| 5. | $C_8F_{17}SO_3K$ | 24 mg |
| 6. | $C_8F_{17}SO_2N(C_3H_7)(CH_2CH_2O)(CH_2)_4—SO_3Na$ | 48 mg |
| 7. | Compound (12) | 30 mg |
| 8. | $H_2O$ | 950 ml |

Compound (12)

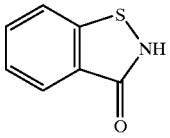

Preparation of Antihalation Backing Layer

On the back side surface of an undercoated polyethylene terephthalate support having a thickness of 175 μm, antihalation layer coating solution (a) and the back surface protective layer coating solution were simultaneously coated and dried in such a manner that the coating amount of the solid content of the solid fine particle dye of antihalation layer coating solution (a) became 0.05 g/m$^2$ and the gelatin coating amount of the back surface protective layer coating solution became 1.4 g/m$^2$, thereby an antihalation backing layer was prepared.

The emulsion layer, the interlayer, the first protective layer and the second protective layer were simultaneously multilayer-coated by slide bead coating on the opposite side of the backing layer side in this order from the undercoating side, thereby photothermographic photosensitive material Sample Nos. 1 to 9 were prepared.

Coating speed was 160 m/min. The distance between the tip of the coating die and the support was 0.18 mm. The pressure in the low pressure chamber was set lower than atmospheric pressure by 392 Pa. In the subsequent chilling zone, air of dry-bulb temperature of 18° C. and wet-bulb temperature of 12° C. was blown at average wind speed of 7 m/sec. After the coating solution was dried, dry air of dry-bulb temperature of 30° C. and wet-bulb temperature of 18° C. was blown at drying zone for 20 seconds, thereby the solvent in the coating solution was evaporated.

Each sample was evaluated as follows. The results obtained are shown in Table 1.

Measurement of Softening Point of Matting Agent

The temperature at which endothermic change attributing to the phase change of each matting agent powder began to occur was measured using a differential scanning calorimeter (model TA7000, manufactured by ULVAC Co.), and this temperature was taken as a softening point.

Measurement of Friction Coefficient at 120° C.

A plate heater of an aluminum plate, the surface of which was nickel plated and the heat plate surface was buff-finished, was maintained at 120° C. A sample was placed on the plate heater in such a manner that the test surface of the sample (back surface) was in contact with the heat plate. After 20 seconds, a load of 15 g/cm$^2$ was applied to the sample and the sample was pulled at a speed of 2 cm/second in parallel to the surface. The frictional force imposed at that time (g/cm$^2$) was measured.

The value obtained by dividing the frictional force (g/cm$^2$) by the applied load (g/cm$^2$) was taken as a friction coefficient.

Measurement of Passing Property on Plate Heater Surface

A sheet-like sample of the photosensitive material having a size of 35 cm×25 cm was passed in a heat developing apparatus of a plate heater system shown in FIGS. 1 and 2 with the test surface (back surface) of the sample being in contact with the plate heater maintained at 120° C., and the passing property was evaluated visually according to the following criteria.

○: Passed without problem.

Δ: Meandered a little but passed (practicable).

×: Meandered heavily but passed with difficulty (impracticable).

××: Did not pass.

Evaluation of Frictional Property of Plate Heater Surface

Sheet-like samples having a size of 35 cm×25 cm (500 sheets each) were passed in a heat developing apparatus at 120° C. and, after all the sheets had passed, the surface of the plate heater was observed to examine the presence or absence of scratches on the glossy surface of plating.

The results of evaluations of Sample Nos. 1 to 9 with varying the amounts and kinds of matting agents are summarized in Table 1.

TABLE 1

| Sample No. | Matting Agent Kind | Number Average Particle Size (μm) | Softening Point (° C.) | Coating Amount (mg/m$^2$) | Dynamic Friction Coefficient at 120° C. | Passing Property on Heater Surface | Scratch on Heater Surface (visual observation) |
|---|---|---|---|---|---|---|---|
| 1 (Comparison) | None | — | — | — | 0.60 or more | xx | Could not evaluate as sample did not pass |
| 2 (Comparison) | PMMA | 6.0 | 90 | 60 | 0.32 | x | Absence |
| 3 (Comparison) | PMMA | 8.5 | 90 | 60 | 0.30 | x | Absence |
| 4 (Invention) | SG-600 | 6.4 | 105 | 60 | 0.22 | ○ | Absence |
| 5 (Invention) | SG-800 | 8.0 | 105 | 30 | 0.22 | ○ | Absence |
| 6 (Invention) | SG-800 | 8.0 | 105 | 60 | 0.20 | ○ | Absence |
| 7 (Invention) | SG-800 | 8.0 | 105 | 90 | 0.19 | ○ | Absence |
| 8 (Invention) | Zonyl MP -1300 | 8.6 | 250 | 60 | 0.20 | ○ | Absence |

TABLE 1-continued

| Sample No. | Matting Agent Kind | Number Average Particle Size (μm) | Softening Point (° C.) | Coating Amount (mg/m²) | Dynamic Friction Coefficient at 120° C. | Passing Property on Heater Surface | Scratch on Heater Surface (visual observation) |
|---|---|---|---|---|---|---|---|
| 9 (Comparison) | Silica | 6.2 | 1,000° C. or more | 60 | 0.21 | ○ | Occurred conspicuously |

SG-600 (crosslinking type, PMMA series, manufactured by Soken Kagaku Co., Ltd.)
SG-800 (crosslinking type, PMMA series, manufactured by Soken Kagaku Co., Ltd.)
Zonyl MP-1300 (Teflon series, manufactured by Mitsui Du Pont Fluoro Chemical Co., Ltd.)

Sample Nos. 4 to 8 according to the present invention showed good passing property on the surface of the plate heater and excellent in friction resistance against the plate heater surface as compared with Comparative Sample Nos. 1 to 3 and 9. Further, it was found that the samples according to the present invention did not generate density unevenness and exhibited good photographic properties.

EFFECT OF THE INVENTION

According to the present invention, excellent transporting property can be obtained, and the durability of a heat developing apparatus is improved, such as the surface of a heating means is not damaged, further, density unevenness due to heat development can be prevented.

While the invention has been described in detail and with reference to specific examples thereof, it will be apparent to one skilled in the art that various changes and modifications can be made therein without departing from the spirit and scope thereof.

What is claimed is:

1. A photothermographic material to be heat developed with a heat source, wherein said photothermographic material comprises on one side of a support (a) a catalytically active amount of photocatalyst, (b) a reducing agent, (c) a reducible silver salt, and (d) a binder, wherein the photothermographic material further comprises an organic matting agent having a softening temperature of from 100 to 500° C. at least on one side of said support, wherein the number average particle diameter of said matting agent is from 1 to 15 μm, and wherein the amount of the matting agent is 20 to 250 mg in terms of a coating amount per m² of the photothermographic material.

2. The photothermographic material as claimed in claim 1, wherein said photothermographic material has a layer containing a catalytically active amount of photocatalyst on one side of the support and contains said matting agent in the surface of the side of the support opposite to the side on which said layer containing a catalytically active amount of photocatalyst is provided.

3. The photothermographic material as claimed in claim 1, which is a photothermographic material to be heat developed with a heat developing apparatus, wherein said photothermographic material contains said matting agent in the surface of the side of the support which is touched to the plate heater of the heat developing apparatus, and the dynamic friction coefficient between said plate heater and the surface containing the matting agent at 120° C. is 0.30 or less.

4. The photothermographic material as claimed in claim 3, wherein the dynamic friction coefficient between said plate heater and the surface containing the matting agent at 120° C. is 0.1 to 0.25.

5. The photothermographic material as claimed in claim 1, wherein said photothermographic material contains gelatin in the surface of the side of the support containing the matting agent.

6. The photothermographic material as claimed in claim 1, wherein the amount of the matting agent is 20 to 250 mg in terms of a coating amount per m2 of the photothermographic material.

7. The photothermographic material as claimed in claim 1, wherein the organic matting agent is selected from the group consisting of polymethyl acrylate, high density polyethylene, polyacrylonitrile, polymethylpentene, acrylonitrile-α-methylstyrene copolymers, polystyrene, polyvinylidene chloride, styrene/divinylbenzene copolymers, polyvinyl acetate, polyethylene carbonate, thermosetting polybutadiene, polyallylate, polytetrafluoroethylene, cellulose acetate and cellulose acetate propionate, carboxyl starch and carboxynitrophenyl starch, modified polyolefin, polyethylene terephthalate, phenolic resins, reinforced polyamide, polyamideimide, crosslinkable polymethyl methacrylate and polytetrafluoroethylene.

8. A heat developing method which comprises heat developing by making the photothermographic material as claimed in claim 1 contact with the plate heater.

9. The photothermographic material as claimed in claim 1, wherein the organic matting agent is polymeric.

10. The photothermographic material as claimed is claim 1, wherein the matting agent-containing layer also contains binder.

11. The photothermographic material as claimed in claim 10, wherein the binder in the matting agent-containing layer is 0.1 to 5 g/m² of the photosensitive material.

12. The photothermographic material as claimed in claim 1, wherein the organic matting agent is present in a surface protective layer and has a number average particle diameter of from 6.4–8.6 micron.

13. The photothermographic material as claimed in claim 1, wherein the organic matting agent is present in a surface protective layer.

14. A photothermographic material to be heat developed with a heat developing apparatus, wherein said photothermograhic material comprises on one side of a support (a) a catalytically active amount of photocatalyst, (b) a reducing agent, (c) a reducible silver salt, and (d) a binder, wherein the photothermographic material further comprises an organic matting agent having a softening temperature of from 100 to 250° C. at least on one side of said support, wherein the number average particle diameter of said matting agent is from 1 to 15 μm, and wherein the amount of the matting agent is 20 to 250 mg in terms of a coating amount per m² of the photothermographic material.

* * * * *